US012098907B2

(12) United States Patent
Nerheim et al.

(10) Patent No.: US 12,098,907 B2
(45) Date of Patent: Sep. 24, 2024

(54) SERIAL ELECTRODE DEPLOYMENT FOR CONDUCTED ELECTRICAL WEAPON

(71) Applicant: Axon Enterprise, Inc., Scottsdale, AZ (US)

(72) Inventors: Magne H. Nerheim, Paradise Valley, AZ (US); David Ryan Bartling, Scottsdale, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 0 days.

(21) Appl. No.: 18/116,893

(22) Filed: Mar. 3, 2023

(65) Prior Publication Data

US 2023/0213317 A1 Jul. 6, 2023

Related U.S. Application Data

(63) Continuation of application No. 17/693,148, filed on Mar. 11, 2022, now Pat. No. 11,624,590, which is a continuation of application No. PCT/US2021/021255, filed on Mar. 5, 2021.

(60) Provisional application No. 62/985,883, filed on Mar. 5, 2020.

(51) Int. Cl.
*F41H 13/00* (2006.01)

(52) U.S. Cl.
CPC ..... *F41H 13/0025* (2013.01); *F41H 13/0012* (2013.01); *F41H 13/0018* (2013.01)

(58) Field of Classification Search
CPC ..... F41H 13/0012; F41H 13/0018; F41H 13/0025; F41A 17/063
USPC ..... 361/232
See application file for complete search history.

(56) References Cited

U.S. PATENT DOCUMENTS

| | | | |
|---|---|---|---|
| 3,803,463 | A | 4/1974 | Cover |
| 4,101,112 | A | 7/1978 | Conners et al. |
| 7,520,081 | B2 | 4/2009 | Kroll |
| 7,859,818 | B2 | 12/2010 | Kroll et al. |
| 7,950,176 | B1 | 5/2011 | Nemtyshkin et al. |
| 7,950,329 | B1 | 5/2011 | Nemtyshkin et al. |

(Continued)

FOREIGN PATENT DOCUMENTS

| | | | |
|---|---|---|---|
| CN | 101410689 | B | 10/2012 |
| CN | 209726930 | U | 12/2019 |

(Continued)

OTHER PUBLICATIONS

European Patent Office, Extended European Search Report for European Application No. 21763883.2 mailed Feb. 26, 2024.

(Continued)

*Primary Examiner* — Yemane Mehari
(74) *Attorney, Agent, or Firm* — Andrew Graham

(57) ABSTRACT

A conducted electrical weapon may deploy a first electrode. Deploying the first electrode may include deploying fewer electrodes than a minimum number required by the conducted electrical weapon to provide the stimulus signal at a remote location. The first electrode may be deployed in response to a first activation signal of a plurality of activation signals. The conducted electrical weapon may deploy a second electrode in response to a second activation signal of the plurality of activation signals. A signal generator of the conducted electrical weapon may provide a stimulus signal between the first electrode and the second electrode.

20 Claims, 10 Drawing Sheets

(56) References Cited

U.S. PATENT DOCUMENTS

| | | | | |
|---|---|---|---|---|
| 10,060,710 | B2 * | 8/2018 | Nerheim | F41H 13/0018 |
| 11,041,698 | B2 | 6/2021 | Nemtyshkin et al. | |
| 2010/0315756 | A1 | 12/2010 | Gavin | |
| 2017/0241752 | A1 | 8/2017 | Nerheim | |
| 2017/0241753 | A1 | 8/2017 | Nerheim et al. | |
| 2018/0045494 | A1 | 2/2018 | Heroor et al. | |
| 2018/0058825 | A1 | 3/2018 | Hyde et al. | |
| 2019/0128650 | A1 | 5/2019 | Kim | |
| 2019/0186873 | A1 | 6/2019 | Salisbury et al. | |
| 2019/0271772 | A1 * | 9/2019 | Nerheim | F41H 13/0025 |
| 2020/0109925 | A1 * | 4/2020 | Goodchild | F41A 17/063 |
| 2020/0109933 | A1 * | 4/2020 | Brundula | F41A 19/58 |

FOREIGN PATENT DOCUMENTS

| | | | |
|---|---|---|---|
| EP | 1673843 | B1 | 12/2008 |
| RU | 2275576 | C1 | 4/2006 |
| RU | 68671 | U1 | 11/2007 |
| RU | 2351871 | C1 | 4/2009 |
| RU | 2477441 | C1 | 3/2013 |
| RU | 2480704 | C2 | 4/2013 |
| RU | 2526159 | C2 | 8/2014 |
| RU | 2527242 | C2 | 8/2014 |
| TW | I364525 | B | 5/2012 |
| TW | I623723 | B | 5/2018 |
| WO | 2007/033181 | A2 | 3/2007 |
| WO | 2009/025575 | A1 | 2/2009 |
| WO | 2018/111140 | A1 | 6/2018 |
| WO | 2021/002922 | A2 | 1/2021 |

OTHER PUBLICATIONS

Taiwan IPO, Office Action (2nd) and Search Report for Taiwanese Application No. 110107979 mailed May 16, 2023.

China National Intellectual Property Administration, First Office Action Notice for Chinese Application No. 202180030382.0 mailed May 26, 2023.

Korean Intellectual Property Office, International Search Report for International Application No. PCT/US2021/021255 mailed Jul. 14, 2021.

Taiwan Patent Office, Office Action for Taiwanese Application No. 110107979 mailed Jun. 28, 2022.

IP Australia, Examination Report No. 1 for Australian Application No. 2021231901 mailed Nov. 3, 2023.

Taiwan Patent Office, Allowance Decision of Examination for Taiwanese Application No. 110107979 mailed Sep. 4, 2023.

Canada Intellectual Property Office, Office Action for Canadian Application No. 3,170,076 mailed Nov. 28, 2023.

Chinese Patent Office, Notification for Patent Registration Formalities for Chinese Application No. 202180030382.0 mailed Oct. 24, 2023.

Taiwan Patent Office, Office Action for Taiwanese Application No. 112147173 mailed Jun. 3, 2024.

* cited by examiner

SERIAL ELECTRODE DEPLOYMENT FOR CONDUCTED ELECTRICAL WEAPON

CROSS-REFERENCE TO RELATED APPLICATION

This application is a continuation of U.S. application Ser. No. 17/693,148, filed Mar. 11, 2022, which is a continuation of International Application No. PCT/US21/21255, filed Mar. 5, 2021, which claims the benefit of U.S. Provisional Application No. 62/985,883, filed Mar. 5, 2020, the disclosures of which are incorporated by reference herein in their entirety.

FIELD OF THE INVENTION

Embodiments of the present disclosure relate to a conducted electrical weapon ("CEW").

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Figure 1:
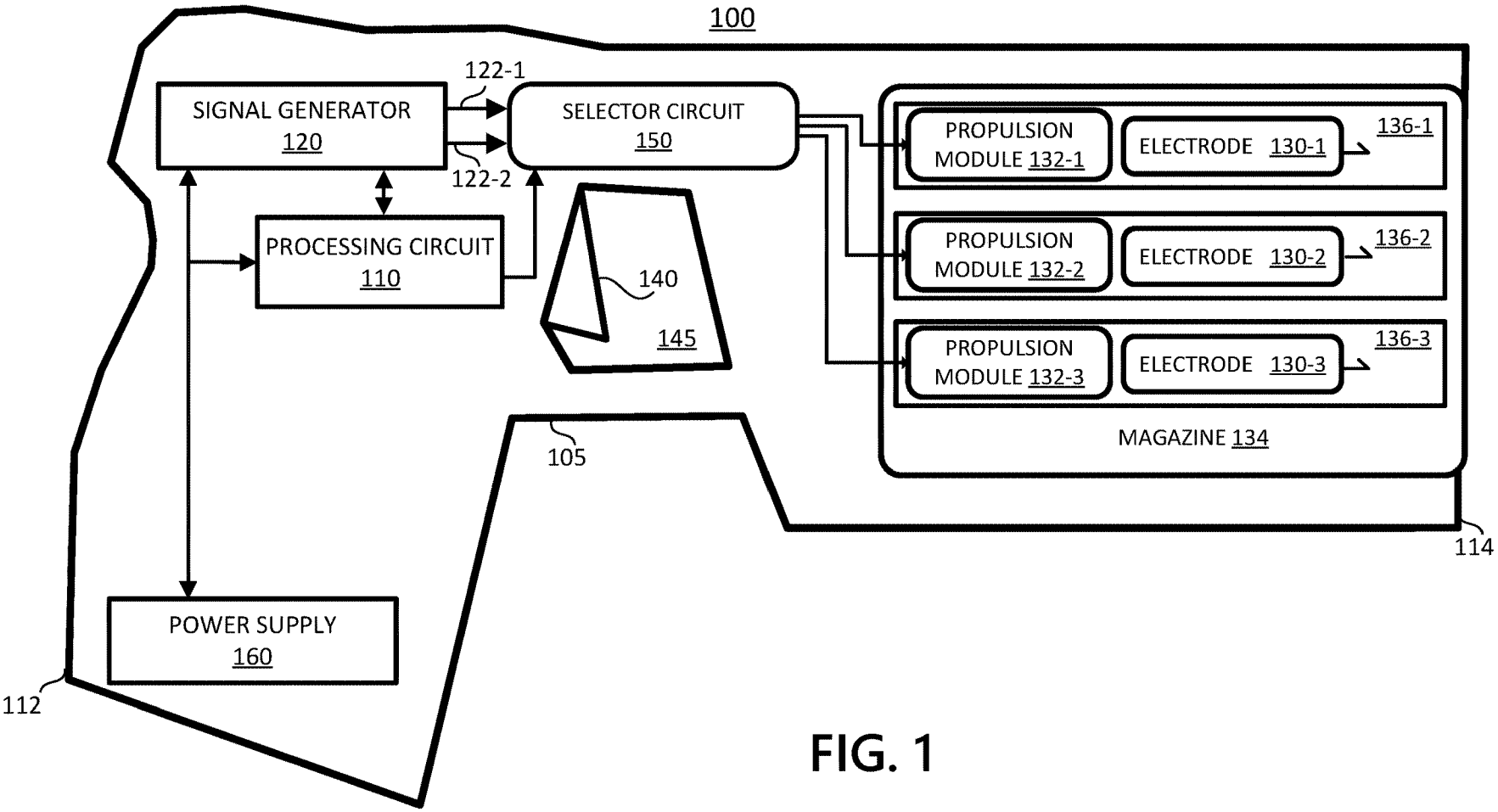
FIG. 1 illustrates a schematic diagram of a conducted electrical weapon in accordance with various embodiments.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected, or the like may include permanent, removable, temporary, partial, full, and/or any other possible attachment option. Additionally, any reference to without contact (or similar phrases) may also include reduced contact or minimal contact. Surface shading lines may be used throughout the figures to denote different parts but not necessarily to denote the same or different materials.

Systems, methods, and apparatuses may be used to interfere with voluntary locomotion (e.g., walking, running, moving, etc.) of a target. For example, a CEW may be used to deliver a stimulus signal through tissue of a human or animal target. Although typically referred to as a conducted electrical weapon, as described herein a "CEW" may refer to a conductive electrical weapon, a conducted energy weapon, and/or any other similar device or apparatus configured to provide a stimulus signal through one or more deployed projectiles (e.g., electrodes).

A stimulus signal may comprise a current. The current may be delivered through a target. The current may comprise multiple units of current. For example, the current may comprise pulses of current, wherein each pulse provides a portion of current of a stimulus signal. Delivering a stimulus signal may comprise coupling the current through a load. For example, delivering a stimulus signal may comprise coupling current of the stimulus signal through a target (e.g., target tissue, tissue of a target). Delivering a stimulus signal to a remote location may comprise coupling a current of the stimulus signal through a load at the remote location.

A stimulus signal may comprise at least two voltages. The at least two voltages may comprise at least two different voltages. For example, a stimulus signal may comprise a first voltage different from a second voltage. A current of the stimulus signal may be determined in accordance with a difference in potential (e.g., voltage difference) between the at least two voltages. The at least two voltages may be coupled across a load to determine a current of the stimulus signal delivered to the load. Upon being coupled to a load, a current of a stimulus signal may flow through the load in accordance with the at least two voltages.

In embodiments, delivering a stimulus signal may comprise providing the at least two voltages. Providing the at least two voltages may comprise generating one or more voltages of the least two voltages. For example, a processing circuit may generate an output signal comprising a first voltage of the at least two voltages. Providing the at least two voltages may comprise conducting the at least two voltages to a location. For example, providing a first voltage of at least two voltages to a remote location may comprise conducting the first voltage of the at least two voltages to the remote location. The at least two voltages may be provided to the location independent of whether the at least two voltages are conductively coupled to an object at the location. The at least two voltages may be provided to the location when none of the at least two voltages are conductively coupled to an object at the location. The at least two voltages may be provided to the location when none of the at least two voltages are conductively coupled across a load at the location. For example, a first voltage and a second voltage of at least two voltages may be provided to a remote location independent of whether the first voltage is coupled to a target at the remote location or the second voltage is coupled to the target at the remote location. Delivering a stimulus signal to a location may comprise providing the at least two voltages to the location, wherein the at least two voltages are further coupled to a load at the location to deliver a current of the stimulus signal across the load at the location.

A stimulus signal carries a charge into target tissue. The stimulus signal may interfere with voluntary locomotion of the target. The stimulus signal may cause pain. The pain may also function to encourage the target to stop moving. The stimulus signal may cause skeletal muscles of the target to become stiff (e.g., lock up, freeze, etc.). The stiffening of the muscles in response to a stimulus signal may be referred to as neuromuscular incapacitation ("NMI"). NMI disrupts voluntary control of the muscles of the target. The inability of the target to control its muscles interferes with locomotion of the target.

A stimulus signal may be delivered through the target via terminals coupled to the CEW. Delivery via terminals may be referred to as a local delivery (e.g., a local stun, a drive stun, etc.). During local delivery, the terminals are brought close to the target by positioning the CEW proximate to the target. The stimulus signal is delivered through the target's tissue via the terminals. To provide local delivery, the user of the CEW is generally within arm's reach of the target and brings the terminals of the CEW into contact with or proximate to the target.

A stimulus signal may be delivered through the target via two or more wire-tethered electrodes. Delivery via wire-tethered electrodes may be referred to as a remote delivery (e.g., a remote stun). During a remote delivery, the CEW may be separated from the target up to the length (e.g., 15 feet, 20 feet, 30 feet, etc.) of the wire tether. The CEW launches (e.g., deploys) the electrodes towards the target. As the electrodes travel toward the target, the respective wire tethers deploy behind the electrodes. The wire tether electrically couples the CEW to the electrode. The electrode may electrically couple to the target thereby coupling the CEW to the target. In response to the electrodes connecting with, impacting on, or being positioned proximate to the target's tissue, current of the stimulus signal may be provided through the target via the electrodes. For example, current of a stimulus signal may be provided via a closed circuit formed through the first tether and the first electrode, the target's tissue, and the second electrode and the second tether.

Terminals or electrodes that contact or are proximate to the target's tissue deliver the stimulus signal through the target. Contact of a terminal or electrode with the target's tissue establishes an electrical coupling with the target's tissue. Electrodes may include a spear that may pierce the target's tissue to contact the target. A terminal or electrode that is proximate to the target's tissue may use ionization to establish an electrical coupling with the target's tissue. Ionization may also be referred to as arcing.

In use (e.g., during deployment), a terminal or electrode may be separated from the target's tissue by the target's clothing or a gap of air. In various embodiments, a signal generator of the CEW may provide the stimulus signal (e.g., current, pulses of current, etc.) at a high voltage (e.g., in the range of 40,000 to 100,000 volts) to ionize the air in the clothing or the air in the gap that separates the terminal or electrode from the target's tissue. Ionizing the air establishes a low impedance ionization path from the terminal or electrode to the target's tissue that may be used to deliver the stimulus signal into the target's tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage, etc.), the ionization path collapses (e.g., ceases to exist) and the terminal or electrode is no longer electrically coupled to the target's tissue. Lacking the ionization path, the impedance between the terminal or electrode and target tissue may be high. A high voltage in the range of about 50,000 volts can ionize air in a gap of up to about one inch.

A CEW may provide a stimulus signal comprising a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode or terminal and a target to electrically couple the electrode or terminal to the target. In response to the electrode or terminal being electrically coupled to the target, the low voltage portion of the pulse delivers an amount of charge into the target's tissue via the ionization path. In response to the electrode or terminal being electrically coupled to the target by contact (e.g., touching, spear embedded into tissue, etc.), the high portion of the pulse and the low portion of the pulse both deliver charge to the target's tissue. Generally, the low voltage portion of the pulse delivers a majority of the charge of the pulse into the target's tissue. In various embodiments, the high voltage portion of a pulse of the stimulus signal may be referred to as the spark or ionization portion. The low voltage portion of a pulse may be referred to as the muscle portion.

In various embodiments, a signal generator of the CEW may provide the stimulus signal at only a low voltage (e.g., less than 2,000 volts). The low voltage stimulus signal may not ionize the air in the clothing or the air in the gap that separates the terminal or electrode from the target's tissue. A CEW having a signal generator providing stimulus signals at only a low voltage (e.g., a low voltage signal generator) may require deployed electrodes to be electrically coupled to the target by contact (e.g., touching, spear embedded into tissue, etc.).

A CEW may include at least two terminals at the face of the CEW. A CEW may include two terminals for each bay that accepts a deployment unit (e.g., cartridge). The terminals are spaced apart from each other. In response to the electrodes of the deployment unit in the bay having not been deployed, the high voltage impressed across the terminals will result in ionization of the air between the terminals. The arc between the terminals may be visible to the naked eye. In response to a launched electrode not electrically coupling to a target, the current that would have been provided via the electrodes may arc across the face of the CEW via the terminals.

The likelihood that the stimulus signal will cause NMI increases when the electrodes that deliver the stimulus signal are spaced apart at least 6 inches (15.24 centimeters) so that the current from the stimulus signal flows through the at least 6 inches of the target's tissue. In various embodiments, the electrodes preferably should be spaced apart at least 12 inches (30.48 centimeters) on the target. Because terminals on a CEW may be less than 6 inches apart, a stimulus signal delivered through the target's tissue via terminals likely will not cause NMI, only pain.

A series of pulses of a stimulus signal may include two or more pulses separated in time. Each pulse may deliver an amount of charge into the target's tissue. In response to the electrodes being appropriately spaced (as discussed above), the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. In various embodiments, a CEW may be hand-held and use batteries to provide the pulses of the stimulus signal. In response to the amount of charge per pulse being high and the pulse rate being high, the CEW may use more energy than is needed to induce NMI. Using more energy than is needed depletes batteries more quickly.

Empirical testing has shown that the power of the battery may be conserved with a high likelihood of causing NMI in response to the pulse rate being less than 44 pps and the charge per a pulse being about 63 microcoulombs. Empirical testing has shown that a pulse rate of 22 pps and 63 microcoulombs per a pulse via a pair of electrodes will induce NMI when the electrode spacing is at least 12 inches (30.48 centimeters).

In various embodiments, a CEW may include a handle and two or more deployment units. The handle may include one or more bays for receiving the deployment units. Each deployment unit may be removably positioned in (e.g., inserted into, coupled to, etc.) a bay. Each deployment unit may releasably electrically, electronically, and/or mechanically couple to a bay. A deployment of the CEW may launch one or more electrodes toward a target to remotely deliver the stimulus signal through the target. In various embodiments, and as further described below, remotely delivering the stimulus signal may require at least two electrodes to be deployed from the CEW.

In various embodiments, two or more deployment units may be coupled to a bay of a CEW via a magazine. The magazine may be received in the bay of the CEW. The magazine may comprise a plurality of firing tubes. A single deployment unit of the two more deployment units may be received in a single firing tube of the plurality of firing tubes. The two or more deployment units may be received in (e.g., inserted into) the magazine prior to the magazine being coupled to the bay of the CEW. Upon coupling of the magazine into the bay of the CEW, the two or more deployment units may be coupled to the CEW. Coupling the magazine to the CEW via the bay of the CEW may include physically coupling the two or more deployment units to a handle of the CEW via the magazine. For example, a deployment unit in a firing tube of a magazine may be mechanically connected to a handle of a CEW when the magazine is coupled to the CEW via a bay of the CEW. Coupling the magazine to the CEW via the bay of the CEW may include electrically coupling the two or more deployment units to the CEW via the magazine. For example, two or more electrodes may be disposed in electrical communication with a processing circuit of the CEW when a magazine in which the two or more electrodes are disposed is coupled to the CEW via a bay of the CEW.

In various embodiments, a deployment unit may include a single electrode. The deployment unit may launch the single electrode individually or at a same time as another electrode launched from another deployment unit. Launching the electrode may be referred to as activating (e.g., firing) a deployment unit. After use (e.g., activation, firing), a deployment unit may be removed from the bay and replaced with an unused (e.g., not fired, not activated) deployment unit to permit launch of additional electrodes. For example, a magazine in which a used deployment unit is disposed may be removed from the bay, the used deployment unit may be removed from a firing tube of the magazine, an unused deployment may be inserted into the firing tube, and the magazine may be reinserted into the bay.

In various embodiments, and with reference to FIG. 1, a CEW 100 is disclosed. CEW 100 may be similar to, or have similar aspects and/or components with, any CEW discussed herein. CEW 100 may comprise a housing 105 and one or more deployment units 136 (e.g., cartridges). For example, CEW 100 may include a first deployment unit 136-1, a second deployment unit 136-2, and a third deployment unit 136-3. It should be understood by one skilled in the art that FIG. 1 is a schematic representation of CEW 100, and one or more of the components of CEW 100 may be located in any suitable position within, or external to, housing 105.

Housing 105 may be configured to house various components of CEW 100 that are configured to enable deployment of the deployment units 136, provide an electrical current to the deployment units 136, and otherwise aid in the operation of CEW 100, as discussed further herein. A handle of CEW 100 may comprise housing 105 and these various components of CEW 100. Although depicted as a firearm in FIG. 1, housing 105 may comprise any suitable shape and/or size. For example, housing 105 may be configured to be mounted on another device (e.g., aerial vehicle, ground vehicle, remotely controlled vehicle, stationary device, non-stationary device, a combination two or more such devices, etc.). Housing 105 may comprise a handle end 112 opposite a deployment end 114. Deployment end 114 may be configured, and sized and shaped, to receive one or more deployment units 136. Handle end 112 may be sized and shaped to be held in a hand of a user. For example, handle end 112 may be shaped as a handle to enable hand-operation of the CEW by the user. In various embodiments, handle end 112 may also comprise contours shaped to fit the hand of a user, for example, an ergonomic grip. Handle end 112 may include a surface coating, such as, for example, a non-slip surface, a grip pad, a rubber texture, and/or the like. As a further example, handle end 112 may be wrapped in leather, a colored print, and/or any other suitable material, as desired.

In various embodiments, housing 105 may comprise various mechanical, electronic, and/or electrical components configured to aid in performing the functions of CEW 100. For example, housing 105 may comprise one or more of a control interface 140, processing circuit 110, power supply 160, selector circuit 150, and/or signal generator 120. Housing 105 may comprise one or more of each of control interface 140, processing circuit 110, power supply 160, and/or signal generator 120 (e.g., multiple control interfaces, multiple processing circuits, multiple power supplies, and/or multiple signal generators, etc.). Housing 105 may include a guard 145. Guard 145 may define an opening formed in housing 105. Guard 145 may be located on a center region of housing 105 (e.g., as depicted in FIG. 1), and/or in any other suitable location on housing 105. Control interface 140 may be disposed within guard 145. Guard 145 may be configured to protect control interface 140 from unintentional physical contact (e.g., an unintentional activation of trigger 18). Guard 145 may surround control interface 140 within housing 105.

In various embodiments, control interface 140 may include a user control interface. A user control interface may be configured to be manually actuated by a user of CEW 100. A user control interface may include a trigger. A user control interface may be coupled to an outer surface of housing 105, and may be configured to move, slide, rotate, or otherwise become physically depressed or moved upon application of physical contact. For example, control interface 140 may be actuated by physical contact applied to control interface 140 from within guard 145. Control interface 140 may comprise a mechanical or electromechanical switch, button, trigger, or the like. For example, control interface 140 may comprise a switch, a pushbutton, and/or any other suitable type of trigger. Control interface 140 may be mechanically and/or electronically coupled to processing circuit 110. In response to control interface 140 being actuated (e.g., depressed, pushed, etc. by the user), processing circuit 110 may enable deployment of one or more deployment units 136 from CEW 100, as discussed further herein.

In various embodiments, control interface 140 may include an automatic control interface. The automatic control interface may automatically generate signals (e.g., activation signals) in accordance with events automatically detected by the automatic control interface. The events may comprise external events that may be detected independent of a user of a conducted electrical weapon. The external events may or may not be initiated by the user of the conducted electrical weapon. The automatic control interface may detect an external condition associated with the conducted electrical weapon. For example, an automatic control interface may comprise one or more of a clock circuit configured to detect a time, a position sensor to detect a spatial location of a conducted electrical weapon, or distance detector configured to detect a distance between conducted electrical weapon and a location. An event may comprise a change in the external condition detected by the automatic control interface. For example, an external event may comprise a change in time, a change in spatial position, and/or a change in distance between a conducted electrical weapon and a location. Actuation of the automatic control interface may comprise the event being automatically detected by the automatic control interface. In embodiments, the automatic control interface may be integrated with a processing circuit of a conducted electrical weapon. For example, the processing circuit may be configured to perform operations of a control interface, including an automatic control interface.

In various embodiments, power supply 160 may be configured to provide power to various components of CEW 100. For example, power supply 160 may provide energy for operating the electronic and/or electrical components (e.g., parts, subsystems, circuits, etc.) of CEW 100 and/or one or more deployment units 136. Power supply 160 may provide electrical power. Providing electrical power may include providing a current at a voltage. Power supply 160 may be electrically coupled to processing circuit 110 and/or signal generator 120. In various embodiments, and in response to control interface 140 comprising electronic properties and/or components, power supply 160 may be electrically coupled to control interface 140. In various embodiments, and in response to selector circuit 150 comprising electronic properties or components, power supply 160 may be electrically coupled to selector circuit 150. Power supply 160 may provide an electrical current at a voltage. Electrical power from power supply 160 may be provided as a direct current ("DC"). Electrical power from power supply 160 may be provided as an alternating current ("AC"). Power supply 160 may include a battery. The energy of power supply 160 may be renewable or exhaustible, and/or replaceable. For example, power supply 160 may comprise one or more rechargeable or disposable batteries. In various embodiments, the energy from power supply 160 may be converted from one form (e.g., electrical, magnetic, thermal) to another form to perform the functions of a system.

Power supply 160 may provide energy for performing the functions of CEW 100. For example, power supply 160 may provide the electrical current to signal generator 120 that is provided through a target to impede locomotion of the target (e.g., via deployment units 136). Power supply 160 may provide the energy for a stimulus signal. Power supply 160 may provide the energy for other signals, including an ignition signal, as discussed further herein.

In various embodiments, processing circuit 110 may comprise any circuitry, electrical components, electronic components, software, and/or the like configured to perform various operations and functions discussed herein. For example, processing circuit 110 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 110 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 110 may include data buses, output ports, input ports, timers, memory, arithmetic units, and/or the like.

Processing circuit 110 may be configured to provide and/or receive electrical signals whether digital and/or analog in form. Processing circuit 110 may provide and/or receive digital information via a data bus using any protocol. Processing circuit 110 may receive information, manipulate the received information, and provide the manipulated information. Processing circuit 110 may store information and retrieve stored information. Information received, stored, and/or manipulated by processing circuit 110 may be used to perform a function, control a function, and/or to perform an operation or execute a stored program.

Processing circuit 110 may control the operation and/or function of other circuits and/or components of CEW 100. Processing circuit 110 may receive status information regarding the operation of other components, perform calculations with respect to the status information, and provide commands (e.g., instructions) to one or more other components. Processing circuit 110 may command another component to start operation, continue operation, alter operation, suspend operation, cease operation, or the like. Commands and/or status may be communicated between processing circuit 110 and other circuits and/or components via any type of bus (e.g., SPI bus) including any type of data/address bus.

In various embodiments, processing circuit 110 may be mechanically and/or electronically coupled to control interface 140. Processing circuit 110 may be configured to detect an activation, actuation, depression, input, etc. (collectively, an "activation event") at control interface 140. In response to detecting the actuation event, processing circuit 110 may be configured to perform various operations and/or functions, as discussed further herein. Processing circuit 110 may also include a sensor (e.g., a trigger sensor) attached to control interface 140 and configured to detect an activation event of control interface 140. The sensor may comprise any suitable mechanical and/or electronic sensor capable of detecting an activation event at control interface 140 and reporting the activation event to processing circuit 110.

In various embodiments, processing circuit 110 may be mechanically and/or electronically coupled to control interface 140 to receive an activation signal. The activation signal may include one or more of a mechanical and/or electrical signal. The activation signal may be received in accordance with an activation event that occurs (e.g., is applied to, detected by, etc.) at a control interface. Detecting the activation event may comprise receiving the activation signal at processing circuit 110. For example, the activation signal may include a mechanical signal received by control interface 140 and detected by processing circuit 110. At least one of control interface 140 and processing circuit may comprise an electro-mechanical device configured to generate an electrical signal based on a mechanical signal received by control interface 140. Receiving an activation signal at a processing circuit may comprise generating an electrical signal responsive to (e.g., indicative of, corresponding to, associated with, etc.) a mechanical signal received via a control interface. Alternately or additionally, the activation signal may include an electrical signal received by processing circuit 110 from a sensor associated with control interface 140, wherein the sensor may detect an activation event of control interface 140 and provide the electrical signal to processing circuit 110 in accordance with the detected activation event. In embodiments, control interface 140 may generate an electrical signal in accordance with an activation event of control interface 140 and provide the electrical signal to processing circuit 110 as an activation signal.

In embodiments, processing circuit 110 may receive the activation signal from a different electrical circuit or device. For example, the activation signal may be received via a wireless communication circuit (not shown). The activation signal may be received from a different electrical circuit or device separate from processing circuit 110 and CEW 100. The activation signal may be received from a different electrical circuit or device external and in communication with processing circuit 110 and CEW 100. For example, the activation signal may be received from a remote-control device in wireless communication with CEW 100 and processing circuit 110 of CEW 100.

In various embodiments, control interface 140 may be repeatedly actuated to provide a plurality of activation signals. For example, a trigger may be depressed multiple times to provide a plurality of activation events of the trigger, wherein an activation signal is detected, received, or otherwise determined by processing circuit 110 each time the trigger is depressed. Each activation signal of the plurality of activation signals may be separately received by CEW 100 via control interface 140.

In various embodiments, control interface 140 may be actuated multiple times over a period of time to provide a sequence of activation signals. Each activation signal of the sequence may be received at a different, discrete time during the period of time. For example, a trigger of a CEW may be actuated at a first time during a period of time to provide a first activation signal and again actuated at a second time during the period of time to provide a second activation signal. A sequence of activation signals comprising the first activation signal and the second activation signal may be received by the CEW via the trigger during the period of time. CEW 100 may receive the sequence of activation signals via control interface 140 and perform at least one function in response to each activation signal of the sequence.

In various embodiments, processing circuit 110 may be electrically and/or electronically coupled to power supply 160. Processing circuit 110 may receive power from power supply 160. The power received from power supply 160 may be used by processing circuit 160 to receive signals, process signals, and transmit signals to various other components in CEW 100. Processing circuit 110 may use power from power supply 160 to detect an activation event of control interface 140 and generate one or more control signals in response to the detected activation event. The control signal may be based on the actuation. The control signal may be an electrical signal.

In various embodiments, processing circuit 110 may be electrically and/or electronically coupled to signal generator 120. Processing circuit 110 may be configured to transmit or provide control signals to signal generator 120 in response to detecting an actuation of control interface 140. Processing circuit 110 may be configured to transmit or provide control signals to signal generator 120 in response to receiving an activation signal. Multiple control signals may be provided from processing circuit 110 to signal generator 120 in series. In response to receiving the control signal, signal generator 120 may be configured to perform various functions and/or operations, as discussed further herein.

In various embodiments, and with reference again to FIG. 1, signal generator 120 may be configured to receive one or more control signals from processing circuit 110. Signal generator 120 may provide an output signal to one or more deployment units 136 based on the control signals. Signal generator 120 may be electrically and/or electronically coupled to processing circuit 110 and/or deployment units 136. Signal generator 120 may be electrically coupled to power supply 160. Signal generator 120 may use power received from power supply 160 to generate an output signal. For example, signal generator 120 may receive an electrical signal from power supply 160 that has input current and voltage values (e.g., a first input current, a first input voltage, second input current, second input voltage, etc.). Signal generator 120 may transform the electrical signal into an output signal having output current and voltage values (e.g., a first output current, a first output voltage, second output current, second output voltage, etc.). One or more output current and/or voltage values may be different from one or more input current and/or voltage values. For example, a first input voltage of an electrical signal received from a power supply may be transformed into a first output voltage greater than the first input voltage. A transformed output signal provided by a signal generator may comprise one or more voltage and/or current values different from one or more voltage and/or current values of an electrical signal received by the signal generator.

In embodiments, one or more output current and/or the second voltage values may be the same as one or more input current and/or voltage values. For example, a second output voltage provided by a signal generator may comprise (e.g., be equal to) a second input voltage of an electrical signal received from a power supply. Generating a signal by a signal generator may comprise providing one or more signals that may each be changed or unchanged relative to one or more signals received by the signal generator. For example, the signal generator may provide an output signal having a voltage equal to an input voltage received by the signal generator to generate the output signal, and also provide another output signal having a transformed voltage relative to a same or different input voltage received by the signal generator to generate the other output signal. Signal generator 120 may temporarily store power from power supply 160 and rely on the stored power entirely or in part to provide the output signal. Signal generator 120 may also rely on received power from power supply 160 entirely or in part to provide the output signal, without needing to temporarily store power.

Signal generator 120 may be controlled entirely or in part by processing circuit 110. In various embodiments, signal generator 120 and processing circuit 110 may be separate components (e.g., physically distinct and/or logically discrete). Signal generator 120 and processing circuit 110 may be a single component. For example, a control circuit within housing 105 may at least include signal generator 120 and processing circuit 110. The control circuit may also include other components and/or arrangements, including those that further integrate corresponding function of these elements into a single component or circuit, as well as those that further separate certain functions into separate components or circuits. In various embodiments, a processing circuit may comprise one or more of processing circuit 110, signal generator 120, and/or selector circuit 150. In various embodiments, a processing circuit of CEW 100 may be configured to perform one or more operations of processing circuit 110, signal generator 120, and/or selector circuit 150.

Signal generator 120 may be controlled by the control signals to generate an ignition signal having a predetermined current value or values. For example, signal generator 120 may include a current source. The control signal may be received by signal generator 120 to activate the current source at a current value of the current source. An additional control signal may be received to decrease a current of the current source. For example, signal generator 120 may include a pulse width modification circuit coupled between a current source and an output of the control circuit. A second control signal may be received by signal generator 120 to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators 120 may alternatively or additionally be employed, including those that apply a voltage over one or more different resistances to generate signals with different currents. In various embodiments, signal generator 120 may include a high-voltage module configured to deliver an electrical current having a high voltage. In various embodiments, signal generator 120 may include a low-voltage module configured to deliver an electrical current having a lower voltage. For example, signal generator 120 may be configured to provide a stimulus signal having a voltage of equal or less than 2,000 volts.

Responsive to receipt of a signal indicating actuation of control interface 140 (e.g., an activation event), a control circuit provides an ignition signal to one or more deployment units 136. For example, signal generator 120 may provide an electrical signal as an ignition signal to first deployment unit 136-1 in response to receiving a control signal from processing circuit 110. In various embodiments, the ignition signal may be separate and distinct from a stimulus signal. For example, a stimulus signal in CEW 100 may be provided to a different circuit within first deployment unit 136-1, relative to a circuit to which an ignition signal is provided. Signal generator 120 may be configured to generate a stimulus signal. In various embodiments, a second, separate signal generator, component, or circuit (not shown) within housing 105 may be configured to generate the stimulus signal. Signal generator 120 may also provide a return signal path for deployment units 136, thereby completing a circuit for a signal provided to deployment units 136 by signal generator 120. The return signal path may comprise a signal path over which a second output signal is provided by signal generator 120 relative another signal path provided by the signal generator for a first output signal. The return signal path may be conductively coupled between deployment units 136 and other elements in housing 105, including power supply 160. For example, a return signal path may comprise a signal path to which second output signal 122-2 is coupled, wherein the signal path may be further conductively coupled to other elements in housing 105, including processing circuit 110 and/or power supply 160.

Signal generator 120 may generate at least two output signals 122. The at least two output signals 122 may include at least two different voltages. Each different voltage of the at least two different voltages is determined relative to a common reference voltage. The at least two signals may include first output signal 122-1 and second output signal 122-2. The first output signal 122-1 may have a first voltage. The second output signal 122-2 may have a second voltage. The first voltage may be different from the second voltage relative to a common reference voltage (e.g., signal ground, the first voltage, the second voltage, etc.). Selector circuit 150 may couple the first output signal 122-1 and the second output signal 122-2 to deployment units 136. The at least two output signals 122 may be coupled to separate, respective electrical signal paths within CEW 100. The at least two output signals 122 may be provided to a remote location via separate, respective electrical signal paths between CEW 100 and the remote location. Coupling of the at least two output signals 122 through a load at the remote location may enable an electrical signal to be delivered at the remote location, wherein the electrical signal comprises a current determined in accordance with at least two different voltages of the at least two output signals 122 and a resistance of the load. For example, a stimulus signal may be delivered at a remote location in accordance with a first voltage of first output signal 122-1, a second voltage of second output signal 122-1 and a load at the remote location, wherein an amount of current of the stimulus signal is determined in accordance with a resistance of the load and a voltage difference between the first voltage and the second voltage. Providing the stimulus signal at the remote location may comprise providing the first voltage via a first electrical signal path between CEW 100 and the remote location. Providing the stimulus signal at the remote location may comprise providing the second voltage via a second electrode signal path between CEW 100 and the remote location.

In embodiments, CEW 100 may be ungrounded. Being ungrounded may comprise being decoupled from earth ground (e.g., earth, an earth ground voltage, a reference voltage of earth ground, etc.). For example, each component of CEW 100 may be decoupled from (e.g., not in electrical communication with, not conductively coupled with, etc.) earth ground. A signal (e.g., ignition signal, stimulus signal, etc.) may be provided by CEW 100 in accordance with two voltages provided by CEW 100 independent of (e.g., disconnected from) a reference voltage comprising earth ground. For example, an electrical signal provided by CEW 100 may require a closed circuit between two voltages provided by signal generator 120. In embodiments, one voltage of the two voltages may comprise a common ground (e.g., signal ground, power ground, etc.). The common ground may be insulated (e.g., separated from, distinct from, etc.) earth ground. In accordance with such an arrangement, CEW 100 may not require a separate connection to earth ground to provide a stimulus signal to a remote location. Such an arrangement may prevent a user of CEW 100 from accidentally being included in a signal path through which an electrical signal is delivered by CEW 100.

In various embodiments, deployment units 136 may comprise propulsion modules 132 and projectiles. The projectiles may include electrodes 130. Each deployment unit of deployment units 136 may comprise a separate propulsion module and projectile. For example, first deployment unit 136-1 comprises first electrode 130-1 and first propulsion module 132-1, second deployment unit 136-2 comprises second electrode 130-2 and second propulsion module 132-2, and third deployment unit 136-3 comprises third electrode 130-3 and third propulsion module 132-3.

In various embodiments, each electrode of electrodes 130 may be configured to be provide a single conductive signal path between CEW 100 and a remote location upon deployment. For example, each electrode of the electrodes 130 may comprise a single electrical conductor. Further, each electrode of the electrodes 130 may be coupled to CEW 100 via a respective filament. Each filament may further comprise a single conductor. Accordingly, in various embodiments, each electrode of electrodes 130 may be selectively coupled to one of first output signal 122-1 and second output signal 122-2 at a time. For example, at a given time, first electrode 130-1 may be coupled to either first output signal 122-1 and second output signal 122-2; second electrode 130-2 may be coupled to either first output signal 122-1 and second output signal 122-2; and third electrode 130-3 may be coupled to either first output signal 122-1 and second output signal 122-2. In various embodiments, each such electrode of electrodes 130 may either be coupled to a first voltage of first output signal 122-1 or a second voltage of second output signal 122-2 at the given time. A single electrode of electrodes 130 may be configured to conduct a single voltage of a stimulus signal at a time. As noted above, remote delivery of a current, including a current of a stimulus signal, may be determined in accordance with two different voltages provided at a remote location according to various aspects of the present disclosure.

Magazine 134 may be releasably engaged with housing 105. Magazine 134 may include a plurality of firing tubes. Each firing tube may be configured to secure one deployment unit of deployment units 136. Magazine 134 may be configured to launch electrodes 130 housed in deployment units 136 installed in each of the plurality of firing tubes of magazine 134. Magazine 134 may be configured to receive any suitable or desired number of deployment units 136, such as, for example, one deployment unit, two deployment units, three deployment units, six deployment units, nine deployment units, etc. The number of deployment units 136 may be received in magazine 134 at a same time. A number of firing the plurality of tubes disposed in magazine 134 may be equal to the number of deployment units 136.

In various embodiments, propulsion modules 132 may be coupled to, or in communication with respective projectiles in deployment units 136. Propulsion modules 132 may comprise a device, propellant (e.g., air, gas, etc.), primer, or the like capable of providing propulsion forces in deployment units 136. The propulsion force may include an increase in pressure caused by rapidly expanding gas within an area or chamber. A propulsion force from each of propulsion modules 132 may be applied to respective projectiles 130 in deployment units 136 to cause the deployment of electrodes 130. Propulsion modules 132 may provide the respective propulsion forces in response to deployment units 136 receiving one or more ignition signals. For example, first propulsion module 132-1 may provide a first propulsion force to first electrode 130-1 in accordance with a first ignition signal. Second propulsion module 132-2 may provide a second propulsion force to second electrode 130-2 in accordance with a second ignition signal. The second ignition signal may be different from the first ignition signal. For example, the second ignition signal may be provided at a second time different from a first time at which a first ignition signal is provided. The second ignition signal may be provided by a processing circuit (e.g., processing circuit 110, including via further control of and/or performance of operations of signal generator 120 and/or selector circuit 150) responsive to a second activation signal different from a first activation signal received by the processing circuit.

In various embodiments, a propulsion force may be directly applied to a projectile. For example, a first propulsion force may be provided directly to first electrode 130-1 via first propulsion module 132-1. Propulsion module 132-1 may be in fluid communication with electrode 130-1 to provide the propulsion force. For example, the propulsion force from first propulsion module 132-1 may travel within a housing or channel of first deployment unit 136-1 first to electrode 130-1.

In various embodiments, each projectile of deployment units 136 may comprise a type of projectile suitable for remote deployment. For example, the projectiles may be or include electrodes 130 (e.g., electrode darts). Each electrode of electrodes 130 may include a spear portion, designed to pierce or attach proximate a tissue of a target in order to provide a conductive electrical path between the electrode and tissue. For example, first deployment unit 136-1 may include first electrode 130-1, second deployment unit 136-1 may include second electrode 130-2, and third deployment unit 136-3 may include third electrode 130-3. Electrodes 130 may be deployed from deployment units 136 at different times, a same time, or substantially a same time. In embodiments, a single electrode (e.g., first electrode 130-1 or second electrode 130-2) may be launched in response to an ignition signal as further discussed herein.

As noted above, a likelihood of a stimulus signal causing NMI of a target is increased when a spacing between two electrodes through which the stimulus signal is remotely delivered is equal or greater than a minimum spacing of at least six inches. To establish the minimum spacing, two electrodes may be simultaneously deployed from a CEW at a fixed relative angle between the two electrodes. The fixed relative angle may comprise a non-zero angle between a first direction at which a first electrode of the two electrodes is launched from the CEW and a second direction at which a second electrode of the two electrodes is launched from the CEW. In accordance with the fixed relative angle, a spacing between the two electrodes increases as a distance between the two electrodes and the CEW increases. For example, simultaneous launch of two electrodes at a fixed relative angle of 3.5 degrees may enable the minimum distance to be established at a remote location that is a distance of at least nine feet from a CEW. However, a same fixed angle would not enable the minimum spacing to be established for distances of less than eight feet between the CEW and the remote location.

Further, a likelihood of a stimulus signal causing NMI of a target is increased as the spacing between two electrodes through which the stimulus signal is remotely delivered increases. A fixed relative angle at launch between the electrodes may enable a minimum spacing to be obtained for a given distance; however, the fixed relative angle may prevent a spacing greater than the minimum spacing to be established for the given distance. The fixed relative angle may also require both electrodes to be aligned with a target at a same time, prior to the electrodes being deployed at the fixed angle. Such a requirement may be difficult to perform in certain situations, including when a target and/or a CEW are in motion or separated by a substantial relative distance.

Embodiments according to various aspects of the present disclosure overcome these issues and others. Particularly, embodiments according to various aspects of the present disclosure enable a minimum distance to be established at a remote location by two electrodes without requiring the electrodes to be deployed from a CEW at a fixed relative angle. For example, in accordance with various embodiments and with reference to FIGS. 2-3, an exemplary CEW 200 may comprise a trigger 240 and two or more wire-tethered electrodes. The wire-tethered electrodes may comprise electrodes 230 coupled to CEW 200 via conductive filaments 232. A plurality of activation signals 210 may be received by CEW 200. In response to the activation signals 210, CEW 200 may deploy electrodes 230 toward target location 260. In embodiments, CEW 200 may correspond to CEW 100 (with brief reference to FIG. 1).

Figure 2:
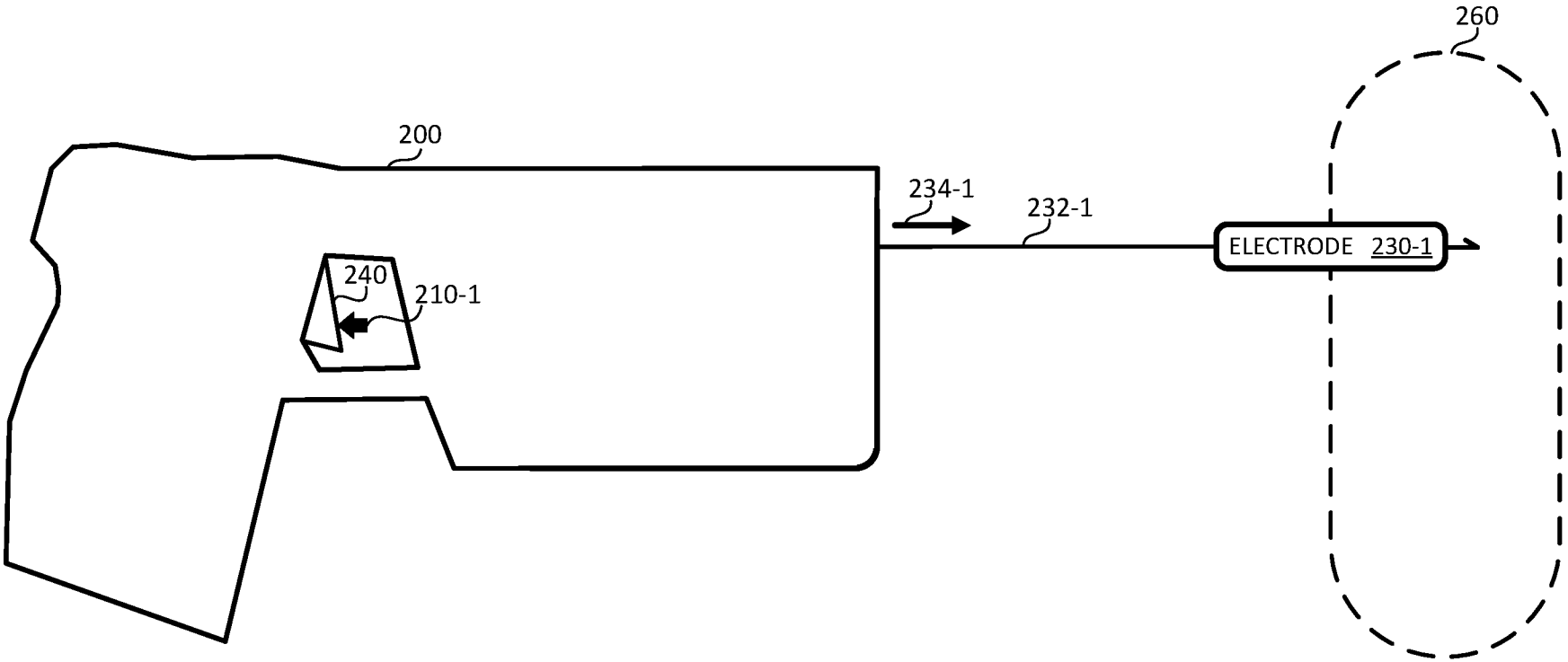
FIG. 2 illustrates an example view of an implementation and use of a conducted electrical weapon in accordance with various embodiments.

At a first point in time, and with reference to FIG. 2, a first activation signal 210-1 may be received via trigger 240 of CEW 200. In response to first activation signal 210-1, CEW 200 may initiate a first launch 234-1. A launch may comprise a total number of projectiles deployed from a CEW in response to a corresponding activation signal. The total number of projectiles may be further deployed from the CEW at a same time or substantially same time. The total number of projectiles may be deployed from the CEW prior to receiving, by the CEW, a subsequent activation signal in a sequence of activation signals comprising the corresponding activation signal (e.g., first activation signal) and the subsequent activation signal (e.g., second activation signal). The total number may comprise a single electrode or a plurality of electrodes (e.g., two electrodes, three electrodes, four electrodes, or more than four electrodes). For example, first launch 234-1 may deploy one or more first electrodes toward remote location 260. The one or more first electrodes may comprise a single electrode 230-1. The one or more first electrodes may comprise only one electrode 230-1. Electrode 230-1 may be the only electrode deployed by CEW 200 in response to activation signal 210-1. Single electrode 230-1 may remain conductively coupled to CEW 200. Single electrode 230-1 may remain conductively coupled to CEW 200 via first filament 232-1. As a sole electrode deployed from CEW 200, no relative angle of launch between electrode 230-1 and another deployed electrode is required, imparted, enforced, or enabled by CEW 200 at the first point in time.

In various embodiments, first launch 234-1 may deploy a partial circuit toward remote location 260. A partial circuit may comprise a number of electrical signal paths deployed between a remote location and a CEW. In embodiments, a number of electrical signal paths deployed may comprise one electrical signal path (e.g., single electrical path). For example, the partial circuit may comprise a first partial circuit. The partial circuit may include electrode 230-1. The partial circuit may include filament 232-1. The partial circuit may comprise a single electrical signal path between CEW 200 and remote location 260. The partial circuit may lack a return signal path. The partial circuit may provide a conductive coupling between CEW 200 and remote location 260. The partial circuit may be insufficient alone to provide a stimulus signal at remote location 260, independent of whether an electrode included in the partial circuit (e.g., electrode 230-1) conductively couples to a conductive load at remote location 260. A partial circuit provided by electrode 230-1 coupled to a conductive load at remote 260 may remain insufficient alone to provide a stimulus signal to remote location. The partial circuit alone may provide a zero voltage between CEW 200 and remote location 260. A difference in potential between remote location 260 and CEW 200 may be zero volts in accordance the partial circuit being deployed between the remote location 260 and CEW 200. However, the partial circuit may not be electrically sufficient to provide a stimulus signal from CEW 200 to remote location 260, as a second electrical signal path may not be provided by CEW 200 and remote location. For example, a return signal path may not be provided to a signal generator of CEW 200 (e.g., signal generator 120 of CEW 100 with brief reference to FIG. 1). A second voltage, required by CEW 200 to deliver a stimulus signal at remote location 260, may not be enabled to be provided responsive to first activation signal 210-1 in accordance with a number of electrical signal paths between CEW 200 and remote location 260. The partial circuit may be prevented (e.g., electrically prohibited, precluded in accordance with electrical properties of, physically unable, etc.) from providing a current at remote location 260 unless at least another partial circuit path is provided between CEW 200 and remote location 260. The partial circuit alone may be inhibited from providing a stimulus signal at remote location 260.

In various embodiments, first launch 234-1 alone may not enable electrical coupling between CEW 200 and remote location 260. First launch 234-1, absent another launch by CEW 200, may be insufficient to provide a stimulus signal between CEW 200 and the remote location 260. A first partial circuit issued from CEW 200 in response to first activation signal 210-1 may establish a conductive coupling between CEW 200 and remote location 260, but preclude an electrical coupling between CEW 200 and remote location 260 responsive to first activation signal 210-1 alone. Electrode 230-1 may remain electrically decoupled between CEW 200 and remote location 260 in accordance with a first activation signal 210-1 alone.

Responsive to first activation signal 210-1, CEW 200 may deploy electrode 230-1 toward remote location 260, but delivery of a stimulus signal via electrode 230-1 may not be enabled. Delivery of current of the stimulus signal via electrode 230-1 may not be enabled. The delivery of current via electrode 230-1 may not be enabled until another activation signal 210 is received via CEW 200. The delivery of current via electrode 230-1 may not be enabled unless another launch of one or more second electrodes from CEW 200 occurred prior to first launch 234-1. The delivery of current via electrode 230-1 may not be enabled until another launch of one or more second electrodes from CEW 200 after first launch 234-1. The delivery of current via electrode 230-1 may not be enabled unless two activation signals of activation signals 210 have been received by CEW 200. The two activation signals of activation signals 210 may be associated with two actuations of trigger 240 of CEW 200. The delivery may not be enabled in accordance with the single conductive coupling provided by electrode 230-1 between CEW 200 and remote location 260.

Figure 3:
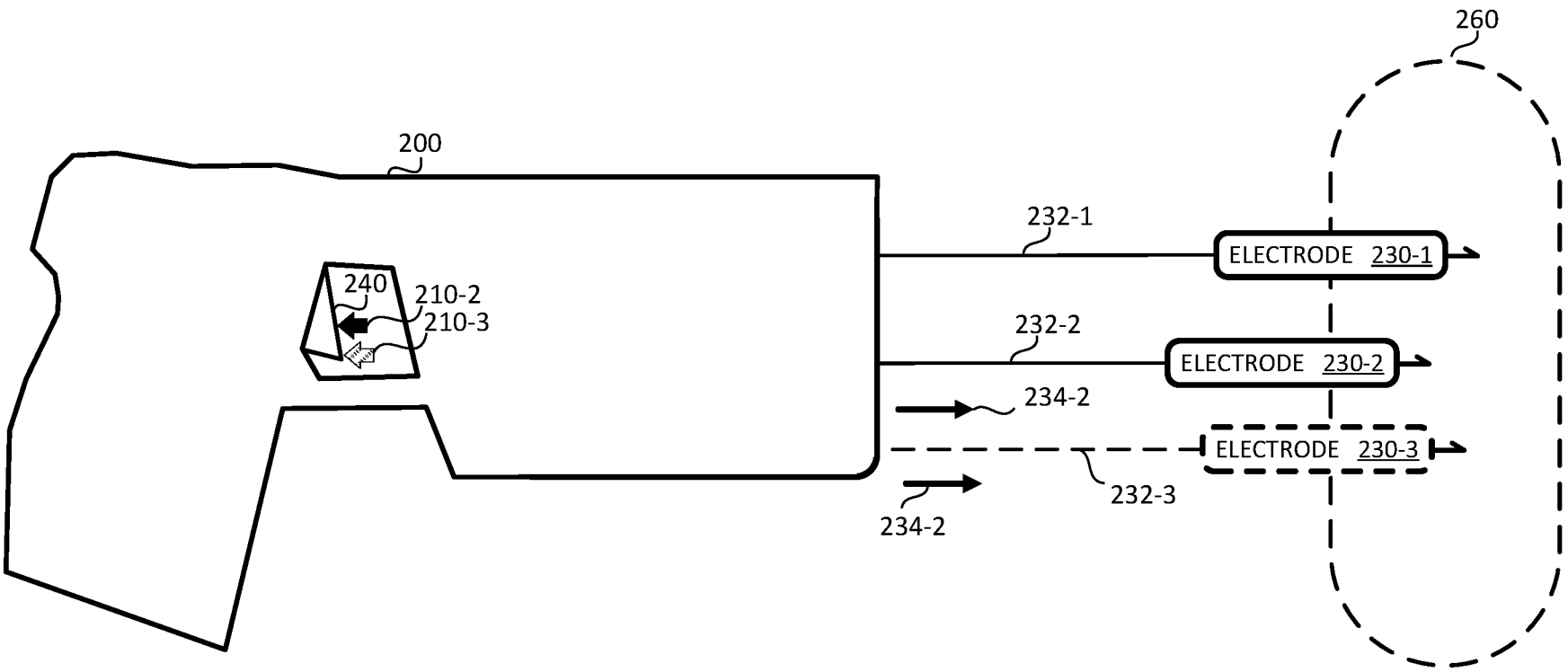
FIG. 3 illustrates an example view of an implementation and use of a conducted electrical weapon in accordance with various embodiments.

At a second point in time, and with reference to FIG. 3, second activation signal 210-2 may be received by CEW 200. Second activation signal 210-2 may be received via a control interface of CEW 200. The control interface may be a same control interface by which first activation signal 210-1 is received by CEW 200. In response to second activation signal 210-2, CEW 200 may initiate a second launch 234-2. Second launch 234-2 may deploy one or more second electrodes toward remote location 260. The one or more second electrodes may comprise a single second electrode 230-2. In embodiments, second electrode 230-2 may be a sole (e.g., only) electrode deployed by CEW 200 in response to second activation signal 210-2. Electrode 230-2 may remain conductively coupled to CEW 200 via filament 232-2. A relative angle of launch between electrode 230-2 and another deployed electrode may not be predetermined, required, established or otherwise limited by CEW 200 at the second point in time.

In various embodiments, second launch 234-1 may deploy a partial circuit toward remote location 260. The partial circuit of second launch 234-2 may comprise a second electrode 230-2. Second electrode 230-2 may provide the partial circuit between CEW 200 and remote location 260. The partial circuit may include second filament 232-2.

In embodiments, a partial circuit of second launch 234-2 may comprise a second partial circuit relative to another partial circuit of another launch of CEW 200. For example, second partial circuit may be different from a first partial circuit of first launch 234-1. The partial circuit of second launch 234-2 may comprise a second single electrical signal path between CEW 200 and remote location 260. The second partial circuit may lack a return signal path. The second electrode 260-2 issued from CEW 200 in response to second activation signal 210-1 may enable remotely delivery of current from CEW 200 via a first partial circuit of another launch of CEW (e.g., a first partial circuit of first launch 234-1) including first electrode 230-1. The second electrode 260-2 issued from CEW 200 in response to second activation signal 210-1 may enable remote delivery of current from CEW 200 via a second partial circuit including second electrode 230-1. The second partial circuit may establish a second conductive coupling between CEW 200 and remote location 260.

In various embodiments, second launch 234-2 may enable electrical coupling between CEW 200 and remote location 260. An electrical coupling may enable an electrical signal to be transmitted (e.g., conducted) between a CEW and a remote location via two or more conductive couplings between the CEW and the remote location. Second launch 234-2 may be sufficient to provide a stimulus signal between CEW 200 and the remote location 260 via a first partial circuit comprising first electrode 230-1. A current of the stimulus signal may be delivered to a target at remote location in accordance with both first launch 234-1 and second launch 234-2. A second partial circuit issued from CEW 200 in response to second activation signal 210-2 may establish a conductive coupling between CEW 200 and remote location 260, as well as enable an electrical coupling between CEW 200 and remote location 260 in accordance with another conductive coupling provided by a first partial circuit of a first launch 234-1 responsive to a first activation signal 210-1. First electrode 230-1 of first launch 234-1 may be electrically coupled between CEW 200 and remote location 260 in accordance with a second activation signal 210-2.

In various embodiments, second launch 234-2 may comprise a plurality of electrodes. The plurality of electrodes may comprise a plurality of second electrodes. The plurality of second electrodes may include an array of electrodes. For example, the plurality of second electrodes may include second electrode 230-2 and third electrode 230-3. In accordance with second activation signal 210-2 and second launch 234-2, both second electrode 230-2 and third electrode 230-3 may be deployed at a same time. Second electrode 230-2 may remain conductively coupled to CEW 200 via second filament 232-2 and third electrode 230-3 may remain conductively coupled to CEW 200 via third filament 232-3. A relative angle of launch between second electrode 230-2 and another electrode (e.g., first electrode 230-1) of a different launch may not be predetermined, required, established or otherwise limited by CEW 200 at the second point in time. A relative angle of launch between third electrode 230-3 and another electrode (e.g., first electrode 230-1) of a different launch may not be predetermined, required, established or otherwise limited by CEW 200 at the second point in time.

In various embodiments, second launch 234-1 may deploy electrode 230-2 and electrode 230-3 toward remote location 260. Each of second electrode 230-2 and third electrode 230-3 may provide a partial circuit between CEW 200 and remote location 260. Second electrode 230-2 may provide a second partial circuit path and may include second filament 232-2. Third electrode 230-3 may provide a third partial circuit path and may include third filament 232-3.

In various embodiments, second launch 234-2 of a plurality electrodes alone may enable electrical coupling between CEW and remote location 260. Second launch 234-2 may enable providing a stimulus signal between CEW 200 and the remote location 260 via a second partial circuit comprising second electrode 230-2 and a third partial circuit comprising third electrode 230-3. In such embodiments, first launch 234-1 may provide an additional partial circuit between CEW 200 and remote location by which the stimulus signal may be provided. The stimulus signal may be provided before first launch 234-1 in accordance with deployed electrodes of second launch 234-2. Additionally, second launch 234-2 may enable a current of the stimulus signal to be provided at remote location 260 via a first partial circuit comprising electrode 230-1.

Accordingly, one or more first electrodes deployed from CEW 200 is response to first activation signal 210-1 may be fewer in number than one or more second electrodes deployed from CEW 200 is response to second activation signal 210-2. A number of the one or more first electrodes and a number of the one or more second electrodes may be different.

Alternately, and in various other embodiments, third electrode 230-3 may be deployed in response to a third activation signal 210-3 different from second activation signal 210-3. A third launch 234-3 comprising third electrode 230-2 may be initiated by a processing circuit of CEW 200 in response to third activation signal 210-3. Third launch 234-3 may be initiated at a different time (e.g., third time or third point in time) during a period of time in which first launch 234-1 and second launch 234-2 are initiated. A relative angle of launch between each of first electrode 230-1, second electrode 230-1, and third electrode 230-3 may not be predetermined, required, established or otherwise limited by CEW 200 at the third point in time. In these embodiments each of a plurality of electrodes may be deployed individually in accordance with a respective activation signal 210. Delivery of a stimulus signal may be enabled via a first partial circuit comprising electrode 230-1 upon first activation signal 210-1 and either of second activation signal 210-2 or third activation signal 210-3. Delivery of current of the stimulus signal may be enabled via a first partial circuit comprising electrode 230-1 upon first launch 234-1 and either of second launch 234-2 or third launch 234-3. Delivery of current may be enabled upon a minimum two activation signals of plurality of activation signals 210. Delivery of a stimulus signal may be enabled via a minimum two launches of plurality of launches 234.

In embodiments, a plurality of activation signals 210 may comprise a sequence of activation signals. The sequence of activation signals may include a first activation signal and a second activation signal distinct from the first activation signal. The first activation signal may be received before or after the second activation signal. For example, the plurality of activation signals may include first activation signal 210-1 received at a first time and second activation signal 210-2 received at a second time, different from the first time. In embodiments, first activation signal 210-1 may be received before or after second activation signal. The sequence of activation signals may include a third activation signal different from the first activation signal and the second activation signal. For example, a sequence of activation signals received by CEW 200 may include third activation signal 210-3. The third activation signal may be received before or after each of the first activation signal and the second activation signal of the sequence of activation signals.

Figure 4:
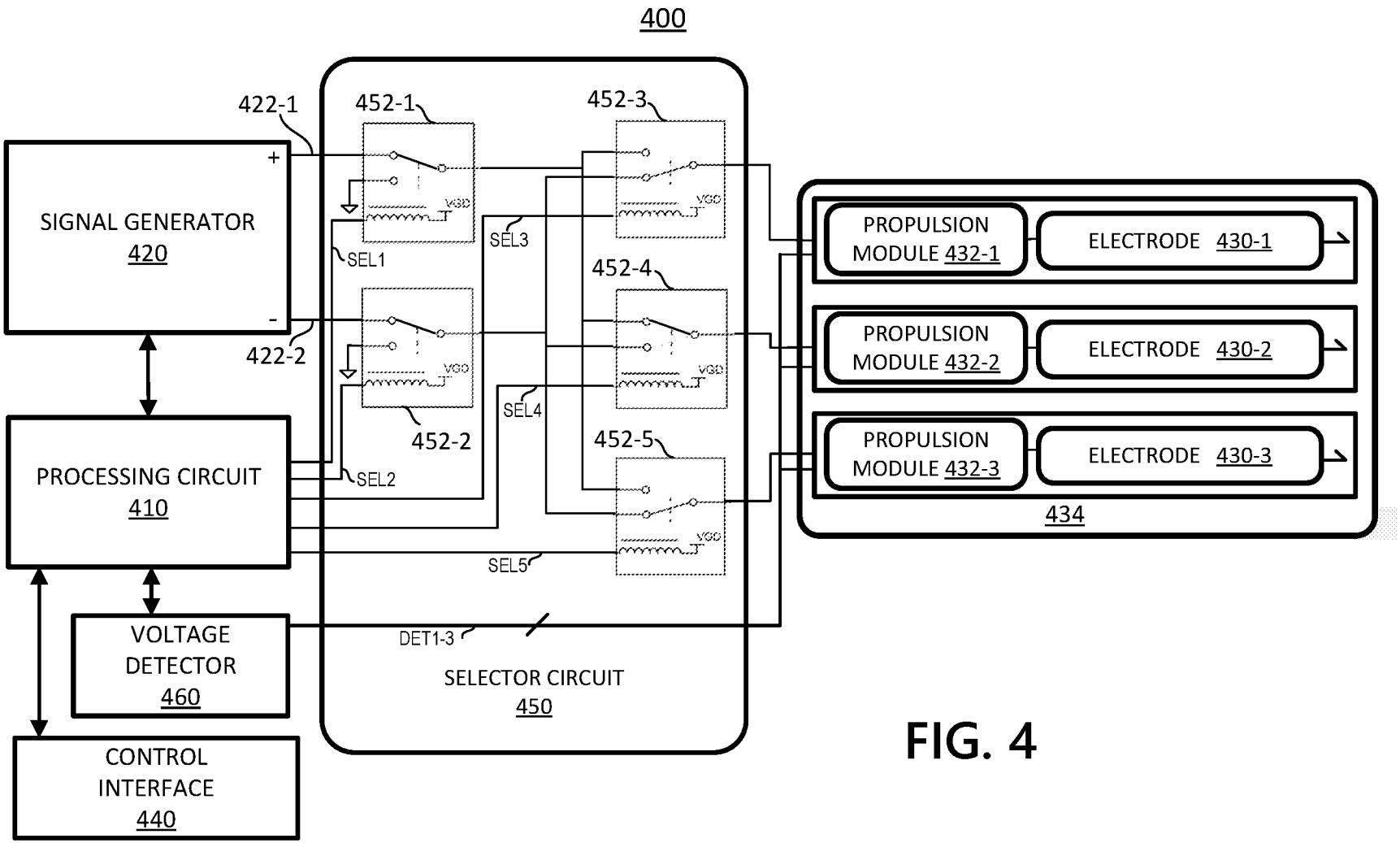
FIG. 4 illustrates a block diagram of an electrical control circuit of a conducted electrical weapon in accordance with various embodiments.

In accordance with various embodiments, a conducted electrical weapon may comprise a control circuit that enables both a series of electrodes to be deployed and a stimulus signal to be coupled across two or more electrodes in the series of electrodes. FIG. 4 illustrates a block diagram of a control circuit of a conducted electrical weapon, in accordance with various embodiments. The conducted electrical weapon comprising control circuit 400 may comprise one or more of CEW 100 or CEW 200 (with brief reference to FIGS. 1 and 2). Control circuit 400 may comprise a processing circuit 410, a signal generator 420, control interface 440, selector circuit 450, and voltage detector 460. Control circuit 400 may be selectively conductively coupled to electrodes 430 and propulsion modules 432 of the conducted electrical weapon. Signal generator 420 may include a plurality of output signals 422, including a first output signal 422-1 and a second output signal 422-2. Electrodes 430 may be coupled to propulsion modules 432 and, prior to deployment, further disposed in magazine 434. Selector circuit 450 may comprise a plurality of switches 452, selection signals SEL1-SEL5, and detection signals DET1-3. In embodiments, certain circuits of control circuit 400 may perform one or more functions of corresponding circuits of FIG. 1. For example, processing circuit 110 may comprise processing circuit 410, signal generator 120 may comprise signal generator 420, selector circuit 150 may comprise selector circuit 450, etc.

In embodiments, processing circuit 410 may be configured to receive and provide various signals, including control signals selected to cause one or more elements of control circuit 400 to perform functions. Processing circuit 410 may detect or receive one or more activation signals from control interface 440. Processing circuit 410 may also receive one or more status signals from voltage detector 460. In response to the one or more activation signals and the one or more status signals, processing circuit 410 may provide one or more control signals.

In embodiments, processing circuit 410 may be configured to provide one or more control signals to signal generator 420. The one or more control signals may cause the signal generator 420 to begin generating an electrical signal. The one or more control signals may cause the signal generator 420 to stop generating an electrical signal. The one or more control signals may cause the signal generator 420 to adjust one or more of an amplitude, frequency, and duty cycle of an electrical signal generated by signal generator 420. The one or more control signals may cause the signal generator 420 to generate a type of electrical signal. For example, processing circuit 410 may provide one or more control signals to cause the signal generator to generate an ignition signal and a stimulus signal. The one or more control signals may cause the signal generator 420 generate a sequence of different types of electrical signals. For example, processing circuit 410 may provide one or more control signals to signal generator 420 to instruct signal generator 420 provide an ignition signal followed by a stimulus signal in sequence. In embodiments, the one or more control signals may instruct the signal generator to stop generating an electrical signal. The one or more control signals may instruct the signal generator to stop generating the electrical signal for a period of time.

Signal generator 420 may be configured to receive one or more control signals from processing circuit 410 and perform functions in accordance with the one or more control signals. Responsive to the one or more control signals, signal generator 420 may start generating an electrical signal, stop generating the electrical signal, adjust one or more of an amplitude, frequency, and duty cycle of the electrical signal, generate a type of electrical signal, and generate a sequence of types of electrical signals. The sequence of types may include one or more same types in a sequence (e.g., pulse of stimulus signal), as well as sequences that include periods of time between electrical signals in which the electrical signal is not generated.

Signal generator 420 may be configured to generate an electrical signal comprising two output signals 422. Output signals 422 may correspond to output signals 122 with brief reference to FIG. 1. The output signals may include a first output signal 422-1 and a second output signal 422-2. The electrical signal may provide a current to a load when the first output signal 422-1 and second output signal 422-2 are coupled across the load.

In embodiments, processing circuit 410 may provide one or more control signals to selector circuit 450 to cause selector circuit 450 to selectively apply one or more output signals 422 from signal generator 420 to magazine 434. For example, one or more of the output signals 422 associated with an ignition signal may be selectively applied to one or more propulsion modules 432 to initiate a launch of one or more electrodes 430 from magazine 434. As another example, one or more of the output signals 422 associated with a stimulus signal may be selectively applied to one or more electrodes 430 for remote delivery of the stimulus signal. An output signal (e.g., first output signal 422-1 or second output signal 422-2) may be applied to an electrode of electrodes 430 after the electrode has been deployed from magazine 434. In embodiments, first output signal 422-1 and second output signal 422-2 may be electrically coupled to two different electrodes of electrodes 430 to provide an electrical signal across the two different electrodes. The output signals may be applied to electrodes 430 before an electrical signal is coupled to a load between the electrodes 430.

In embodiments, processing circuit 410 may be configured to apply electrical signals to electrode 430 and/or propulsion modules 432 by providing one or more control signals to switches 452 of selector circuit 450.

Switches 452 may receive two or more input signals and a control signal and, responsive to the control signal, provide one of the input signals as an output signal. Each switch of switches 425 may be disposed in an open state or a closed state. The closed state may couple one or more inputs to one or more outputs of a respective switch of switches 425. While single pull double throw switches are illustrated in FIG. 4, switches 425 may comprise various types of switches and various input and output connections in embodiments according to various aspects of the present disclosure. Switches 452 may include first switches 452-1, 452-2 and second switches 452-3, 452-4, 452-5. First switches 452-1, 452-2 may be controlled to selectively apply (e.g., couple) an output signal of signal generator 420 (e.g., first output signal 422-1 and second output signal 422-1) as an input signal to each of second switches 452-3, 452-4, 452-5. For example, first switch 452-1 may be controlled to selectively apply first output signal 422-1 from signal generator 420 as a first input signal to each of second switches 452-3, 452-4, 452-5. Second switch 452-2 may be controlled to selectively apply second output signal 422-2 from signal generator 420 as a second input signal to each of second switches 452-3, 452-4, 452-5. In embodiments, one of first output signal 422-1 or second output signal 422-2 may comprise a reference voltage (e.g., signal ground). Processing circuit 410 may be configured to provide a first control signal SEL1 to switch 452-1, a second control signal SEL2 to switch 452-2, a third control signal SEL3 to switch 452-3, a fourth control signal SEL4 to switch 452-4, and a fifth control signal SEL5 to switch 452-5 to individually control (e.g., select an input/output coupling) each of the switches 452. Selector circuit 450 comprises switches 452 for purposes of illustration. In embodiments, one or more functions described herein for selector circuit 450 may be implemented by different electrical components and different configurations of any such components, aside from or in addition to any such switches 452. For example, processing circuit 410 may perform one or more operations of switching circuit 450 in embodiments according to various aspects of the present disclosure.

In accordance with a configuration of control circuit 400, a CEW comprising control circuit 400 may have an associated minimum number of electrodes required for remote delivery of an electrical signal. The minimum number may be determined in accordance with a number of different voltages generated by the signal generator for the remote delivery of current of the electrical signal. For example, to deliver the electrical signal at a remote location, each of first output signal 422-1 and second output signal 422-2 may be required to conductively coupled to the remote location. The output signals 422 may be conductively coupled via electrodes 430. In embodiments, each electrode of electrodes 430 may be coupled to signal generator 420 to provide one of the first output signal 422-1 and second output signal 422-2. Each of each of second switches 452-3, 452-4, 452-5 may only provide either of first output signal 422-1 or second output signal 422-2. A single electrode (e.g., first electrode 430-1 or second electrode 430-2, etc.) may not enable (e.g., conduct at a same time) both first output signal 422-1 and second output signal 422-2 to be provided via the electrode 430 to the remote location. Accordingly, in various embodiments, a minimum number of electrodes required by control circuit 400 is two electrodes of 430, wherein each electrode of the two electrodes is respectively coupled to a different one of first output signal 422-1 and second output signal 422-2. Deploying a number of electrodes in a launch may comprise deploying less than the minimum number of electrodes required for remote delivery of an electrical signal. For example, a launch comprising a single electrode may comprise less than the minimum number of electrodes required for remote delivery of an electrical signal in accordance with two different voltages of first output signal 422-1 and second output signal 422-2.

In embodiments, the minimum number may be determined in accordance with a number of the different voltages to which each electrode of electrodes 436 is respectively configured to be coupled at a same time. For example, each electrode of electrodes 436 may be limited from being coupled to more than one voltage of output signals 422. Each electrode may be limited in accordance with a physical limitation of the electrode and/or a partial circuit comprising the electrode. For example, first electrode 430-1 and/or first filament 432-1 may comprise a single electrical signal path, limiting a partial circuit comprising first electrode 430-1 and/or first filament 432-1 to providing a single voltage to a remote location. Alternately or additionally, each electrode may be limited in accordance with a configuration of control circuit 400. For example, processing circuit 410 and/or selector circuit 450 may limit a number of output signals 422 that may be coupled to first electrode 430-1 at a time. Another electrode, aside from first electrode 430-1, may be required to provide a second voltage of a stimulus signal generated by signal generator 420 to a remote location. Accordingly, first electrode 430-1 providing a single voltage may be less than a minimum number of electrodes required for remote delivery of two or more voltages of an electrical signal. A launch comprising only first electrode 430-1 may comprise less than the minimum number of electrodes required for remote delivery of a stimulus signal comprising two different voltages of first output signal 422-1 and second output signal 422-2.

The minimum number may be further determined in accordance with a number of electrodes of a launch that are coupled to a same voltage of the electrical signal. The number of electrodes of the launch may comprise all electrodes of the launch. The electrodes may be coupled to the same voltage in accordance with a configuration of a control circuit. For example, processing circuit 410 and/or selector circuit 450 may couple each of second electrode 430-2 and third electrode 430-3 to a same voltage of one of first output signal 422-1 or second output signal 422-2. Another electrode of a different launch, coupled to the other voltage of first output signal 422-1 or second output signal 422-2, may be required to provide the other voltage to a remote location in order to deliver current of a stimulus signal based on the same voltage and the other voltage. Accordingly, a launch comprising second electrode 430-2 and third electrode 430-3 each coupled to a same voltage of a stimulus signal may be less than a minimum number of electrodes required for remote delivery of two or more voltages of the stimulus signal. For remote delivery of the stimulus signal, at least one additional electrode may be required. In embodiments, the minimum number of electrodes required for remote delivery may be at least two or at least three in accordance with a number of electrodes of a launch that are coupled to a same voltage of the electrical signal. A launch comprising second electrode 430-2 and third electrode 430-3 coupled to a same voltage may comprise less than a minimum number of electrodes required for remote delivery of a stimulus signal based on two voltages of first output signal 422-1 and second output signal 422-2. Accordingly, the minimum number of electrodes required for remote delivery may be more than two electrodes. For greater numbers of electrodes coupled to a same voltage in a launch (e.g., three electrodes, four electrodes, etc.), a corresponding minimum number may be at least one more than the respective number (e.g., four electrodes, five electrodes, etc.). In embodiments, the minimum number may be greater than two.

As discussed elsewhere herein, a conducted electrical weapon may be configured to deploy a single electrode. For example, processing circuit 410 may be configured to deploy a single electrode 430-1 by providing one or more control signals to switches 452-1 and 452-3 to couple the ignition signal to propulsion module 432-1. The ignition signal may comprise a single ignition signal. In embodiment, processing circuit 410 may control selector circuit 450 to provide a single ignition signal to a single electrode. For example, a first single ignition signal may be provided to first electrode 430-1. The first single ignition signal may be provided responsive to a first activation signal (e.g., first activation signal 210-1 with brief reference FIG. 2). A second single ignition signal may be provided to second electrode 430-2. The second single ignition signal may be provided responsive to a second activation signal (e.g., second activation signal 210-1 with brief reference FIG. 2). In embodiments, an internal return signal path (not shown) between signal generator 420 and propulsion modules 432 for selectively coupling an ignition signal across each propulsion module 432 may be provided within selector circuit 450. The internal return path for the ignition signal may be different from a return signal path required for remote delivery of a stimulus signal via two or more deployed electrodes. The internal return signal path may not enable a signal from signal generator to be delivered externally from a conducted electrical weapon comprising control circuit 400. Alternately or additionally, the internal return signal path may comprise a signal path on which an output signal (e.g., second output signal 422-2) is provided in embodiments according to various aspects of the present disclosure.

In embodiments, additional switches may be provided to concurrently couple each propulsion module of propulsion modules 432 to the output signals 422 of signal generator 450 to provide ignition signals to the propulsion modules. The additional switches may comprise additional switches separate from switches 425. The additional switches may enable an ignition signal from signal generator 450 to be provided to an individual propulsion module (e.g., first propulsion module 432-1) via an electrical signal path different from another electrical signal path by which a stimulus signal may be provided to a corresponding individual electrode (e.g., first electrode 430-1).

In embodiments, multiple second switches 452-3, 452-4, and 452-5 may be controlled by processing circuit 410 to apply one or more ignition signals to one or more electrodes, including a plurality of ignition signals to launch a plurality of electrodes at a same time. For example, second switches 452-4 and 452-5 may be both coupled via first switch 450-1 to first output signal 422-1 to provide a launch comprising second electrode 430-2 and third electrode 430-3. In embodiments, processing circuit 410 may control selector circuit 450 to provide at least one ignition signal upon receipt of each activation signal received by processing circuit via control interface 440.

In embodiments, processing circuit 410 may be configured to couple a sequence of ignition signals to each electrode of electrodes 430 in sequence. For example, the sequence of ignition signals may comprise a first ignition signal and a second ignition signal. Each signal of the sequence of ignition signals may be provided by a processing circuit of a conducted electrical weapon to a single electrode or a plurality of electrodes as discussed above.

After an ignition signal is applied to a single electrode (e.g., 430-1) processing circuit 410 may be configured to perform various operations.

In embodiments, processing circuit 410 may be configured to automatically select a set of next electrodes for receiving a next ignition signal. The set may comprise a single electrode. For example, after a first ignition signal is applied to electrode 430-1 via propulsion module 432-1, processing circuit may be configured to automatically send a control signal to switch 452-2 to enable electrode 430-2 to be conductively coupled to signal generator 420 to receive the next ignition signal from signal generator 420. The control signal from processing circuit 450 may be provided to switch 452-4 before a next activation signal is received by processing circuit 410. Automatic selection by processing circuit 410 may enable electrode 430 to efficiently deployed in response to a next activation signal.

In embodiments, processing circuit 410 may delay deployment of a next set of electrodes after a prior set of electrodes is deployed. The next set of electrodes may comprise one or more electrodes. Processing circuit 410 may delay the deploying of a next set of electrodes for a minimum period of time. In embodiments, the minimum period of time may be 50-100 milliseconds. The minimum period of time (e.g., minimum delay) may be selected in accordance with a maximum period of time for debouncing one or more of switches 452. For example, the processing circuit 410 may automatically select a next set of electrodes for deployment and send one or more control signals to switches 452 to enable a next ignition signal to be provided to the set and then delay sending a control signal to signal generator 420 to generate the next ignition signal until the minimum period of time has elapsed. The minimum period of time may be measured relative to a time at which a prior electrode has been deployed. Processing circuit may be configured to prevent deployment of the next set of electrodes during the minimum period of time. A second activation signal received at a second period of time from prior launch of an electrode may not cause the next set of electrodes to be launched if the second period of time is less than the minimum period of time. A second activation signal received at a second period of time from prior launch of an electrode may cause the next set of electrodes to be launched if the second period of time is equal or greater than the minimum period of time. In embodiments, processing circuit 410 may electrically decouple electrodes 430 from signal generator 420 by one or more of delaying a control signal to be sent to signal generator 420 to initiate generation of the ignition signal and applying a control signal to one or more of switches 452-1, 452-2 to conductively decouple signal generator 420 from electrodes 430 and associated propulsion modules 432.

In embodiments, processing circuit 410 may be configured to provide a stimulus signal. Providing the stimulus signal may comprise providing at least one voltage of the stimulus signal. The at least one voltage of the stimulus signal may be provided to at least component of control circuit 400. For example, the at least one voltage may be provided to at least one of selector circuit 450 or at least one electrode of electrodes 430.

In embodiments, providing the stimulus signal may comprise providing one or more control signals to signal generator 420. Signal generator 420 may provide one or more voltages of the stimulus signal responsive to the one or more control signals. Providing the stimulus signal may comprise providing a first voltage of the stimulus signal via first output signal 422-1 of signal generator 420 and providing a second voltage of the stimulus signal via second output signal 422-1 of signal generator 420. Alternately or additionally, signal generator 450 may be configured to automatically generate the one or more voltages of the stimulus signal independent of whether a control signal is provided from processing circuit 410.

In embodiments, providing the stimulus signal by a processing circuit may comprise providing one or more control signals to selector circuit 450. Selector circuit 420 may provide one or more voltages of the stimulus signal to at least one electrode of electrodes 430. Providing the stimulus signal may comprise coupling a first voltage of the stimulus signal via the selector circuit 450-1 to one electrode of electrodes 430 and coupling a second voltage of the stimulus signal via the selector circuit 450-1 to another electrode of electrodes 436 different from the one electrode.

In embodiments, processing circuit 410 may be configured to selectively couple an electrical signal between signal generator 420 and one or more electrodes 430. Selectively coupling may comprise selectively providing a conductive signal path between signal generator 420 and the one or more electrodes 430 via selector circuit 450. Alternately or additionally, the selectively coupling may comprise generating or not generating output signals 422 from signal generator 420, thereby preventing output signals 422 from being applied to the one or more electrodes 430. For example, after launch of a single electrode (e.g., first electrode 430-1), processing circuit 410 may be configured to decouple the single electrode from output signals 422 of signal generator 420. To decouple first electrode 430-1 from signal generator 420 and output signals 422, one or more of first switch 425-1 or second switch 425-3 may be provided in an open state such that signal generator 420 is not conductively coupled to first electrode 430-1. Alternately or additionally, signal generator 420 may not generate one or more of first output signal 422-1 and/or second output signal 422-2 to decouple output signals the one or more of first output signal 422-1 and/or second output signal 422-2 from first electrode 430-1. In embodiments, the single electrode may provide a partial circuit between signal generator 420 and a remote location. For example, a single electrode may be deployed in a first launch, but only one of first output signal 422-1 and second output signal 422-1 may be provided to the remote location via the deployed partial circuit comprising the single electrode. A current (e.g., current of stimulus signal) may not be provided via the partial circuit until another electrode (e.g., electrode 430-2) is deployed from the conducted electrical weapon in which signal generator 420 is provided. The current may be electrically prevented from being provided from a CEW to a remote location, despite the partial circuit having been deployed from the CEW. Accordingly, processing circuit 410 may be configured to decouple the single electrode from signal generator 420 for a period of time between a first time at which single electrode is deployed and a second time at which a second electrode (e.g., electrode 430-2) is deployed. Such an arrangement may increase safety of a conducted electrical weapon by preventing current from being delivered via an accidentally formed signal path during the period of time. Such an arrangement may prevent unintended delivery of an electrical signal from a signal generator of a conducted electrical weapon when a controlled return signal path (e.g., another partial circuit) has not been deployed from the conducted electrical weapon during the period of time.

After a second electrode is deployed, processing circuit 410 may be configured to couple the single first electrode 430-1 and the second electrode 430-2 at a same time. Processing circuit 410 may couple the single first electrode 430-1 and the second electrode 430-2 at a same time to signal generator 420. For example, both switches 452-1 and 452-2 may be operated at a same time to electrically and conductively couple an electrical signal to first electrode 430-1 and second electrode 430-2. Accordingly, an activation signal associated with launch of first electrode 430-1 may not cause a stimulus signal from signal generator 420 to be provided to first electrode 430-1. The stimulus signal may not be coupled across electrode 430-1 and another electrode (e.g., second electrode 430-2) until another activation signal has been received and the other electrode (e.g., second electrode 430-2) has been deployed. In embodiments, a stimulus signal may not be provided (e.g., coupled) to electrode 430-1 during a period of time after deployment of electrode 430-1, independent of whether electrode 430-1 is conductively coupled to an object (e.g., load, target, etc.) at a remote location. A first voltage associated with first output signal 422-1 and a second voltage associated with second output signal 422-2 may be retained at control circuit 400 after a first activation signal is received and until a second activation signal. Providing the stimulus signal via a single first electrode 430-1 may require at least two activation signals to be received.

In embodiments, processing circuit 410 may also provide one or more control signals to voltage detector 460. Voltage detector 460 may be coupled each of one or more electrodes to detect a voltage at each electrode of electrodes 430. Signals DET1-3 may be received by voltage detector 460 to detect the voltage at each electrode of electrodes 430. The voltage may be detected while an electrode of electrodes 430 is deployed at a remote location. Processing circuit 410 may be configured to provide one or more control signals to delay (e.g., prevent, disable, etc.) voltage detector 460 from detecting a voltage for a period of time. The period of time may include a period of time between a time of a first launch comprising on or more first electrodes and a second time of a second launch of one or more second electrodes. For example, processing circuit 410 may control voltage detector 460 to delay detection of a voltage at an electrode (e.g., first electrode 430-1) between a first time at which the electrode is deployed and another electrode (e.g., second electrode 430-2) of electrodes 430 are deployed. After the other electrode is deployed, processing circuit 410 may initiate detection of a voltage at the electrode. After the other electrode is deployed, processing circuit 410 may also initiate detection of a voltage at the other electrode.

In other embodiments, processing circuit 410 may be configured to couple one of output signals 422 to a single electrode (e.g., electrode 430-1) before another electrode is deployed via control circuit 400. For example, processing circuit may be configured to couple first output signal 422-1 to first electrode 430-1 after first electrode 430-1 is launched. In embodiments, a voltage provided via first output signal 422-1 may be provided to a remote location toward which first electrode 430-1 was deployed as an open-circuit voltage. An open circuit may be provided between a conducted electrical weapon from which first electrode 430-1 was deployed and the remote location, wherein a voltage of the first output signal 422-1 is provided to the remote location. However, air or other insulating material may remain between the conducted electrical weapon and the remote location, thereby providing the open circuit and/or open-circuit voltage between the conducted electrical weapon and the remote location. The open-circuit voltage and open circuit may be provided by the insulating material independent of whether the first electrode 430-1 is conductively coupled to an object at the remote location. The other output signal, second output signal 422-2 and a voltage associated with the second output signal 422-2, may be retained at signal generator 420. The open-circuit voltage may be provided between the remote location until at least a second electrode 430-2 is deployed toward the remote location in another launch comprising the second electrode 430-2. Such an arrangement may enable a stimulus signal based on a first voltage of first output signal 422-1 and a second voltage of second output signal 422-2 to be immediately delivered at a remote location after the other launch comprising the second electrode 430-2.

In embodiments, processing circuit 410 may be configured to perform one or more of operations upon deployment of one or more first electrodes and/or one or more second electrodes, rather than just a single electrode. For example, processing circuit 410 may provide a stimulus signal in response to a launch comprising a plurality of electrodes.

Figure 5:
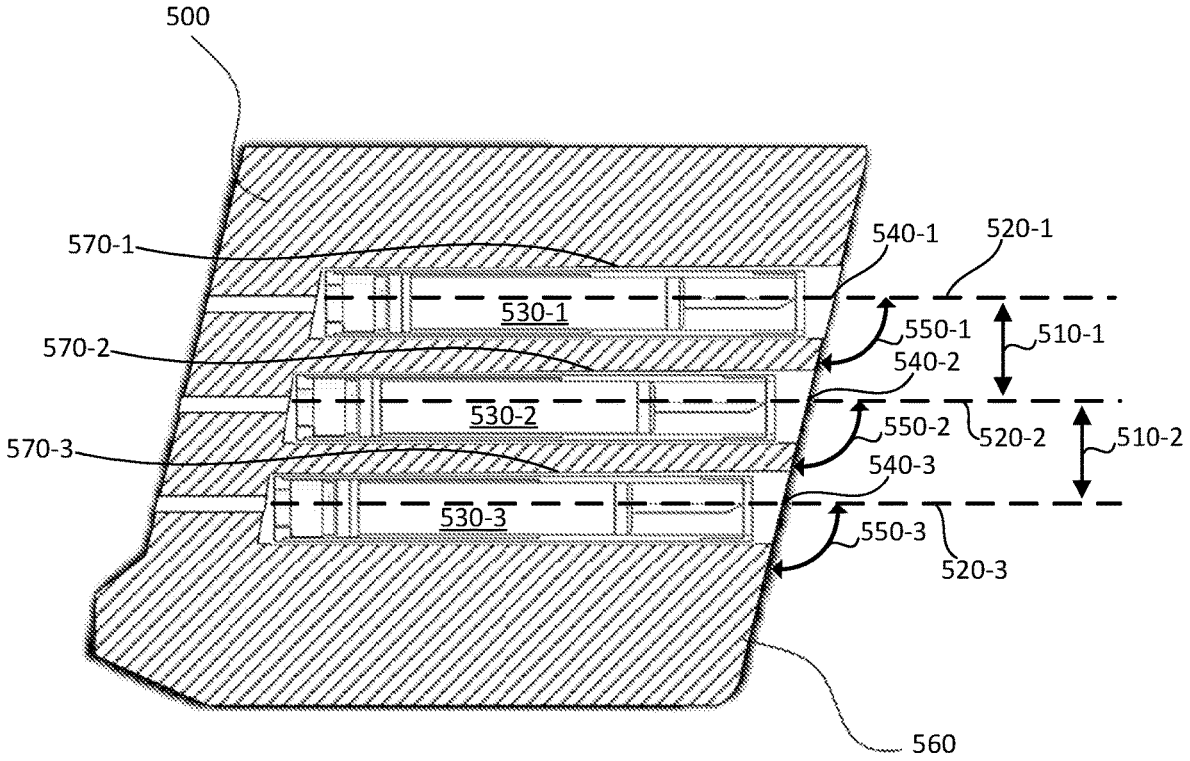
FIG. 5 illustrates a cross-section of a magazine for a conducted electrical weapon in accordance with various embodiments.

In various embodiments, a CEW according to various aspects of the present disclosure may enable a trajectory of each electrode deployed from the CEW to be more predictable. Particularly, the trajectory of each electrode may be deployed at a launch angle corresponding to a direction in which the CEW is aimed, rather than at least one deployed electrode having a launch angle disposed at a fixed angle away from a vertical and/or horizontal direction in which the CEW is aimed. For example, and with reference to FIG. 5, magazine 500 for a CEW according to various embodiments comprises electrodes 530, launch directions 520, spacings 510, locations (e.g., locations of deployment) 540, deployment end 560, and launch angles (e.g., or angles of launch) 550. In embodiments, magazine 500 may correspond to magazine 134 of CEW 100 and electrodes 530 may correspond to electrodes 130 of CEW 100 and/or CEW 200 (with brief reference to FIGS. 1 and 2).

In various embodiments, magazine 500 is configured to launch a plurality of electrodes 530 from respective firing tubes 570. Electrodes 530 may include first electrode 530-1, second electrode 530-2, and third electrode 530-3. Each electrodes of electrode 530 may include a respective wire-tethered electrode.

In various embodiments, electrodes 530 may be configured to launch in launch directions 520 toward deployment end 560 of magazine 500. First electrode 530-1 may launch in first launch direction 520-1, second electrode 530-2 may launch in second launch direction 520-2, and third electrode 530-3 may launch in third launch direction 520-3. Each direction of launch directions 520 may be determined in accordance with a dimensions and positions of respective firing tubes 570 within magazine 500 for each electrode of the electrodes 530 prior to launch. Each direction of launch directions 520 may correspond to a direction at which a respective electrode of electrodes 530 may be deployed toward a target location during use of a CEW comprising magazine 500. Each direction of launch directions 520 may correspond to a central axis of a respective electrode of electrodes 530 prior to deployment of the respective electrode. In embodiments, two or more of launch directions 520 may be parallel to each other. In embodiments, two or more of electrodes 530 may be parallel to each other within magazine 500, prior to being deployed in launch directions 520.

In embodiments, two or more firing tubes 570 of magazine 500 may be parallel to each other. For example, a first firing tube 570-1 in which first electrode 530-1 may be disposed in magazine 500 prior to deployment may be parallel to a second firing tube 570-2 in which second electrode 530-2 may be disposed prior to deployment. The first firing tube 570-1 may be disposed in magazine 500 parallel to a third firing tube 570-3 in which third electrode 530-3 may be disposed prior to deployment.

In various embodiments, launch directions 520 may define angles from which electrodes may be deployed from magazine. The angles may include launch angles 550 for electrodes 530. Electrode 530 may be configured to launch from magazine 500 and a CEW comprising magazine 500 (e.g., CEW 100) at launch angles 550. Launch angles 550 may be determined relative to magazine 500 and/or a CEW comprising magazine 500. For example, launch angles 550 may be determined relative to a common plane at deployment end 560 of magazine 500. The common plane may comprise a same surface at deployment end 560. First electrode 530-1 may be configured to launch from magazine 500 at a first launch angle 550-1, second electrode 530-2 may be configured to launch from magazine 500 at a second launch angle 550-2, and third electrode 530-3 may be configured to launch from magazine 500 at a third launch angle 550-1.

In embodiments, two or more launch angles 550 may include a same launch angle. For example, first launch angle 550-1 may include a same angle as second launch angle 550-2; second launch angle 550-2 may include a same angle as third launch angle 550-3; first launch angle 550-1 may include a same angle as third launch angle 550-3, and all launch angles 550 may include a same launch angle relative to magazine 500. Two or more electrodes 530 may be deployed from a CEW comprising magazine 500 at a same angle. In embodiments, the same angle may include an angle perpendicular relative to a plane at deployment end 560. In embodiments, the same angle may include angles that are parallel to each other relative to a common plane defined relative to magazine 500. In embodiments, relative angles between launch angles 550 may be less than an angle necessary for two or more of electrodes 530 to obtain a minimum spacing for establishing NMI at a remote location at any distance. However, because magazine 500 may be reoriented between deployments of two or more electrodes 530, magazine 500 may yet enable a greater than minimum spacing at the remote location to be achieved.

In embodiments, electrodes 530 may be launched at different times and/or in response to different activation signals. Accordingly, electrodes 530 may exit magazine 500 at locations 540 in close proximity. For example, first electrode 530-2 may exit (e.g., launch from, deploy from) magazine 500 at location 540-1, second electrode 530-2 may exit magazine 500 at location 540-2, and third electrode 530-3 may exit magazine 500 at location 540-3. Locations 540 may be determined relative to directions 520. For example, locations 540 may be determined relative to (e.g., comprise) a center of firing tubes of respective electrodes 530. Alternately, or additionally a respective location of locations 540 may comprise a diameter of a firing tube of a respective electrode of electrodes 530 from which a respective electrode is configured to be deployed from magazine.

Because electrodes 530 may be launched at different times and/or in response to different activation signals, spacings 510 between positions 540 may be minimized. Spacings 510 may comprise a distance between a center of each firing tube in a pair of electrodes. Alternately or additionally, spacings 510 may comprise a shortest distance between two firing tubes of a pair of electrodes 530. Spacings 510 may be determined at deployment end 560 of magazine 500 at which the pair of electrodes may exit magazine 500. Spacings 510 may be less than a minimum spacing necessary for two or more electrodes 530 to establish NMI at a remote location at any distance when the two or more electrodes are launched at a same time and/or in a same launch from magazine 500. For example, a spacing 510-1 between a location of deployment 540-1 for first electrode 530-1 and second electrode 530-2 may be less than a predetermined value. A spacing 510-2 between a location of deployment 540-2 for second electrode 530-2 and third electrode 530-3 may alternately or additionally be less than the predetermined value. In embodiments, the predetermined value may be less than at least one of one inch, less than 1.5 inches, less than 0.75 inches, and less than 0.5 inches. In embodiments, a minimum spacing may be provided between electrodes of electrodes 530 in magazine, and a same launch angle may be provided by magazine 500, yet a spacing of two or more of electrodes 530 at a remote location may be increased. The spacing of the two or more of electrodes 530 may be further increased for any distance between magazine 500 and the remote location. In embodiments, a same magazine 500 may enable spacings of two or more electrodes 530 to be maximized for distances up to 45 feet between magazine 500 and the remote location. A same magazine 500 may enable greater than minimum spacings for establishing NMI to be obtained at multiple ranges of distance toward a remote location, including one or more of above and below five feet, above and below ten feet, above and below fifteen feet, above and below twenty feet, above and below twenty-five feet, above and below thirty feet, above and below thirty-five feet, and above and below forty feet, and further including ranges bound by combinations of two or more of these distances. In embodiments, filaments coupled to electrodes 530 (e.g., filaments 232 coupled to electrodes 230 with brief reference to FIG. 2), may be at least five feet in length, at least ten feet in length, at least fifteen feet in length, at least twenty feet in length, at least twenty-five feet in length, at least thirty feet in length, at least thirty-five feet in length, or at least forty feet in length.

Figure 6:
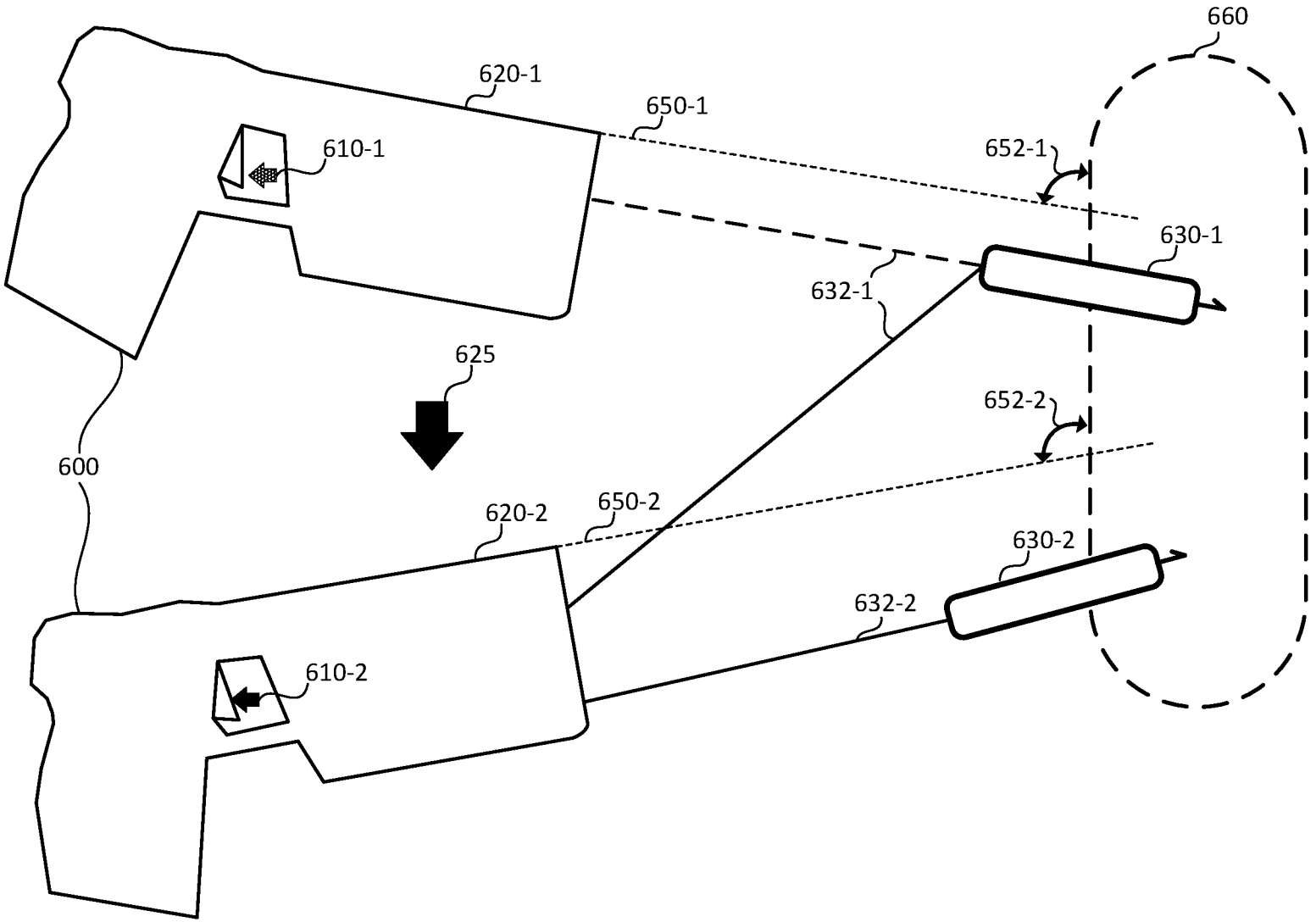
FIG. 6 illustrates an example view of an implementation and use of a conducted electrical weapon in accordance with various embodiments.

In various embodiments, a variable angle of deployment may be provided between a CEW and remote location. The variable angle of deployment may be provided independent of a distance between the CEW upon deployment of either electrode, enabling a maximum spacing to be selected, regardless of a distance or change in distance between the CEW and remote location. For example, in accordance with various embodiments and with reference to FIG. 6, an exemplary CEW 600 may deploy electrodes 630 at angles of deployment 652 that are independent of each other. Launch of the electrodes 630 may be initiated from different positions 620 and in different directions 650 toward remote location 660. In embodiments, CEW 600 may correspond to CEW 100 and/or CEW 200 (with brief reference to FIGS. 1 and 2).

At a first time, CEW 600 may have a first orientation relative to remote location 660. The first orientation may include a first position 620-1. The first orientation may include a first direction 650-1 toward remote location 660. First direction 650-1 may correspond to a direction toward remote location 600 at which first electrode 630-1 may be launched from CEW 600. First direction 650-1 may provide a first angle of deployment 652-1 between CEW 600 and remote location 660. First angle of deployment 652-1 may be determined relative to a plane at remote location 660. The plane may correspond (e.g., be tangential to, intersect, etc.) to one or more surfaces of an object (e.g., target) at remote location 600. Movement of the object may cause a corresponding movement of remote location 660. In embodiments, first angle of deployment 652-1 may include two or more angles between CEW 600 and remote location 660 in three-dimensional space.

At the first orientation, a first activation signal 610-1 may be received. Responsive to the first activation signal 610-1, a first electrode 630-1 may be deployed from CEW 600. First electrode 630-1 may be launched in a direction parallel to first direction 650-1 such that an angle of arrival of electrode 630-1 corresponds to first angle of deployment 652-1. A first filament 632-1 may conductively couple CEW 600 to electrode 630-1.

After the first time, CEW 600 may move 625 to a second position 620-2. CEW 600 may move 625 in accordance with a change in position of CEW 600. The change in position may comprise a relative change in position (e.g., distance, orientation, etc.) between CEW 600 and remote location 660. For example, CEW 600 may move 625 to increase spacing at remote location 660 between first electrode 630-1 and a next electrode, avoid a surface area of an object at remote location 660, or otherwise improve likelihood that the next electrode will be establish NMI of an object at remote location 660. Remote location 660 may comprise a same physical location (e.g., fixed two-dimensional or fixed three-dimensional spatial location) before and after CEW 600 moves 625. In embodiments, CEW 600 may alternately or additionally move 625 in accordance with one or more a user of CEW 600 and remote location 600 being in motion. First filament 632-1 may remain coupled between electrode 630-1 and CEW 600, as CEW 600 moves 625. First electrode 630-1 may remain at a same position at remote location 660 as CEW 600 moves 625. For example, electrode 630 may remain physically coupled to a same surface of an object to which it arrived via first angle of deployment 652-1. CEW 600 may selectively move 625 in accordance with a movement of an object (e.g., user, vehicle, etc.) on which it is mounted or otherwise carried.

At a second time after the first time, CEW 600 may be disposed at a second orientation relative to remote location 660. The second orientation may include a second position 620-2. The second orientation may include a second direction 650-2 toward remote location 660. Second direction 650-2 may correspond to a direction toward remote location 600 at which second electrode 630-2 may be launched from CEW 600. In embodiments, directions 650 may correspond to launch angles of electrodes 630 relative to CEW 600. Second direction 650-2 may provide a second angle of deployment 652-2 between CEW 600 and remote location 660. Second angle of deployment 652-2 may be determined relative to a plane at remote location 660. The plane may be a same plane or a plane parallel to a plane at which angle of deployment 652-1 is defined between CEW 600 and remote location 660 when CEW 600 is disposed at first position 620-1. The plane may correspond to one or more surfaces of an object at remote location, including a same surface of the object at remote location 660 upon launch of first electrode 630-1. Second angle of deployment 652-2 may include two or more angles between CEW 600 and remote location 660 in three-dimensional space.

At the second orientation, a second activation signal 610-2 may be received. Responsive to the second activation signal 610-2, a second electrode 630-2 may be deployed from CEW 600. Second electrode 630-2 may be launched in a direction parallel second direction 650-2 such that an angle of arrival of electrode 630-2 corresponds to second angle of deployment 652-2. A second filament 632-2 may conductively couple CEW 600 to electrode 630-2. Upon deployment of electrode 630-2 to remote location, a stimulus signal is enabled to be provided from CEW 600 via a first conductive electrical signal path comprising electrode 630-1 and filament 632-1 and a second conductive electrical signal path comprising electrode 630-2 and filament 632-2. In embodiments, electrodes 630 may include a first pair of single electrodes deployed toward remote location 660 in accordance with a sequence of activation signals 610.

Accordingly, first angle of deployment 652-1 may be independent of second angle of deployment 652-2. The angles of deployment 652 may be independent of each other and further different in accordance with one or more differences in orientations of CEW 600 at the first time, when first activation signal 610-1 is received or detected by CEW 600, and the second time, when second activation signal 610-2 is received or detected by CEW 600. The independent angles of deployment of electrodes 630 may enable a spacing between electrodes 630 to be selectively increased. The independent angles of deployment of electrodes 630 may enable more accurate placement of each electrode of the electrodes 630 on surface(s) at remote location 660. In embodiments, the independent angles of deployment of electrodes 630 may increase a precision of placement for each electrode of the electrodes 630, potentially decreasing a number of electrodes that need to be deployed to remotely deliver a stimulus signal at remote location 660.

Figure 7:
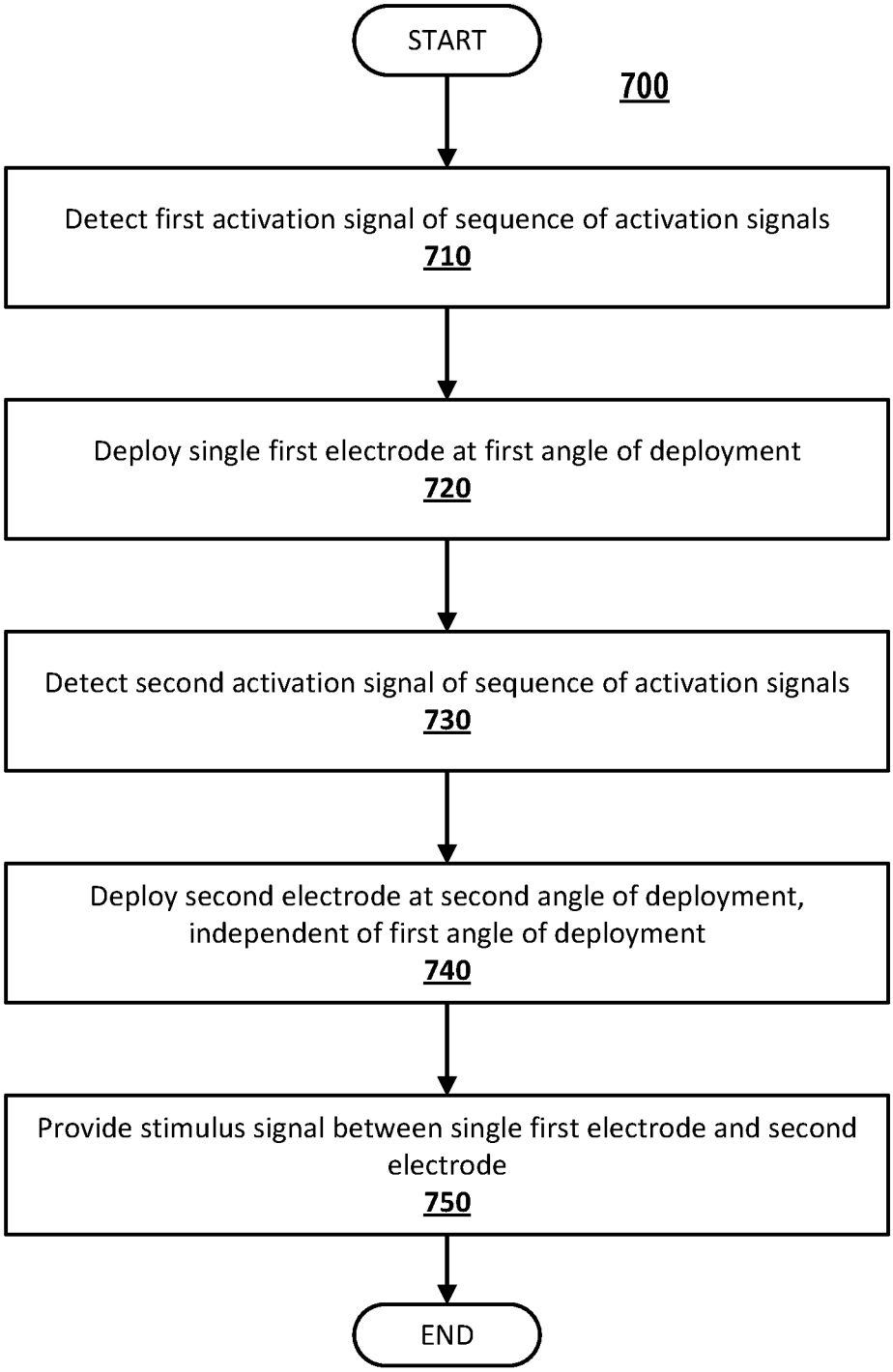
FIG. 7 illustrates a process flow for a method of deploying an electrode in accordance with various embodiments.

In various embodiments, and with reference to FIG. 7, a process flow for a method for deploying an electrode is disclosed. The process flow for method 700 depicts one combination of blocks that may be implemented in accordance with one embodiment. Those of ordinary skill in the art will realize that the process flow for method 700 and/or any other implementations herein may utilize additional and/or fewer blocks, components, and/or systems (including those discussed with respect to other figures and/or known in the art). Further, absent expressly indicating otherwise, the ordering of describing various implementations and blocks is merely for illustrative purposes and not intended to limit the scope of this disclosure. As understood by a person of ordinary skill in the art, a computer-readable medium comprising computer-executable instructions that are configured to be executed by a processor to perform one or more processes disclosed herein. In embodiments, method 700 may be performed by a CEW. For example, method 700 may be implemented by CEW 100 and/or CEW 200 and/or CEW 600 (with brief reference to FIGS. 1-3 and 6). In embodiments, one or more operations of method 700 may be performed by a component of a CEW. For example, one or more operations may be performed by a processing circuit (e.g., processing circuit 110 or processing circuit 410 with brief reference to FIGS. 1 and 4) and/or a control circuit (e.g., control circuit 400 with brief reference to FIG. 4).

Deploying an electrode may include operations comprising detecting a first activation signal of a sequence of activation signals 710, deploying a single first electrode at a first angle of deployment 720, detecting a second activation signal of sequence of activation signals 730, deploying a second electrode at second angle of deployment independent of the first angle of deployment 740, and providing a stimulus signal between the single first electrode and the second electrode 750.

Detecting a first activation signal of a sequence of activation signals 710 may include detecting, by a processing circuit of the conducted electrical weapon, the first activation signal. The first activation signal may comprise the single first activation signal. The first activation signal may be detected from a user control interface in communication with the processing circuit. In embodiments, a second activation signal of the sequence of activation signals may also be detected from the user control interface. For example, detecting a first activation signal of a sequence of activation signals 710 may comprise a processing circuit of CEW 200 or 600 detecting a first activation signal 210-1 and/or first activation signal 610-1 with brief reference to FIGS. 2 and 6.

Deploying a single first electrode at a first angle of deployment 720 may include deploying, by the conducted electrical weapon, the single first electrode in response to the first activation signal of the sequence of activation signals. The single first electrode may comprise a single wire-tethered electrode. For example, deploying a single first electrode at a first angle of deployment 720 may comprise a processing circuit of CEW 200 or 600 deploying first electrode 230-1 and/or first electrode 630-1 with brief reference to FIGS. 2 and 6.

Detecting a second activation signal of sequence of activation signals 730 may comprise detecting, by the processing circuit of the conducted electrical weapon, the second activation signal. The second activation signal may comprise the single second activation signal. For example, detecting a second activation signal of a sequence of activation signals 730 may comprise a processing circuit of CEW 200 detecting second activation signal 210-2 and/or second activation signal 610-2 with brief reference to FIGS. 3 and 6.

Deploying a second electrode 740 may include deploying, by the conducted electrical weapon, the second electrode in response to the second activation signal of the sequence of activation signals. Deploying the second electrode 740 may include deploying a single second electrode. Deploying the second electrode 740 may include deploying the second electrode at second angle of deployment, independent of the first angle of deployment. The single first electrode may be deployed toward a remote location at the first angle of deployment relative to the remote location and the second electrode may be deployed toward the remote location at the second angle of deployment relative to the remote location. The first angle of deployment may be independent of the second angle of deployment. The single first electrode may be deployed from the conducted electrical weapon at a first launch angle and the second electrode may be deployed from the conducted electrical weapon at a second launch angle. The first launch angle may be equal to the second launch angle. The single first electrode may be deployed from the conducted electrical weapon at a first location on the conducted electrical weapon. The second electrode may be deployed from the conducted electrical weapon at a second location on the conducted electrical weapon. A spacing between the first location and the second location may be less than 0.5 inches. For example, deploying the second electrode 740 may comprise a processing circuit of CEW 200 or 600 deploying second electrode 230-2 and/or second electrode 630-2 with brief reference to FIGS. 3 and 6.

Providing a stimulus signal between the single first electrode and the second electrode 750 may include providing, by a signal generator of the conducted electrical weapon, the stimulus signal between the single first electrode and the second electrode. Providing the stimulus signal may include providing the stimulus signal from the signal generator across the single first electrode and the single second electrode after each (e.g., both) of the single first electrode and the single second electrode are deployed from the conducted electrical weapon. For example, providing a stimulus signal between the single first electrode and the second electrode 750 may comprise coupling first output signal 422-1 comprising a first voltage of the stimulus signal to first electrode 430-1 and coupling second output signal 422-2 comprising a second voltage of the stimulus signal to second electrode 430-2 with brief reference to FIG. 4.

Figure 8:
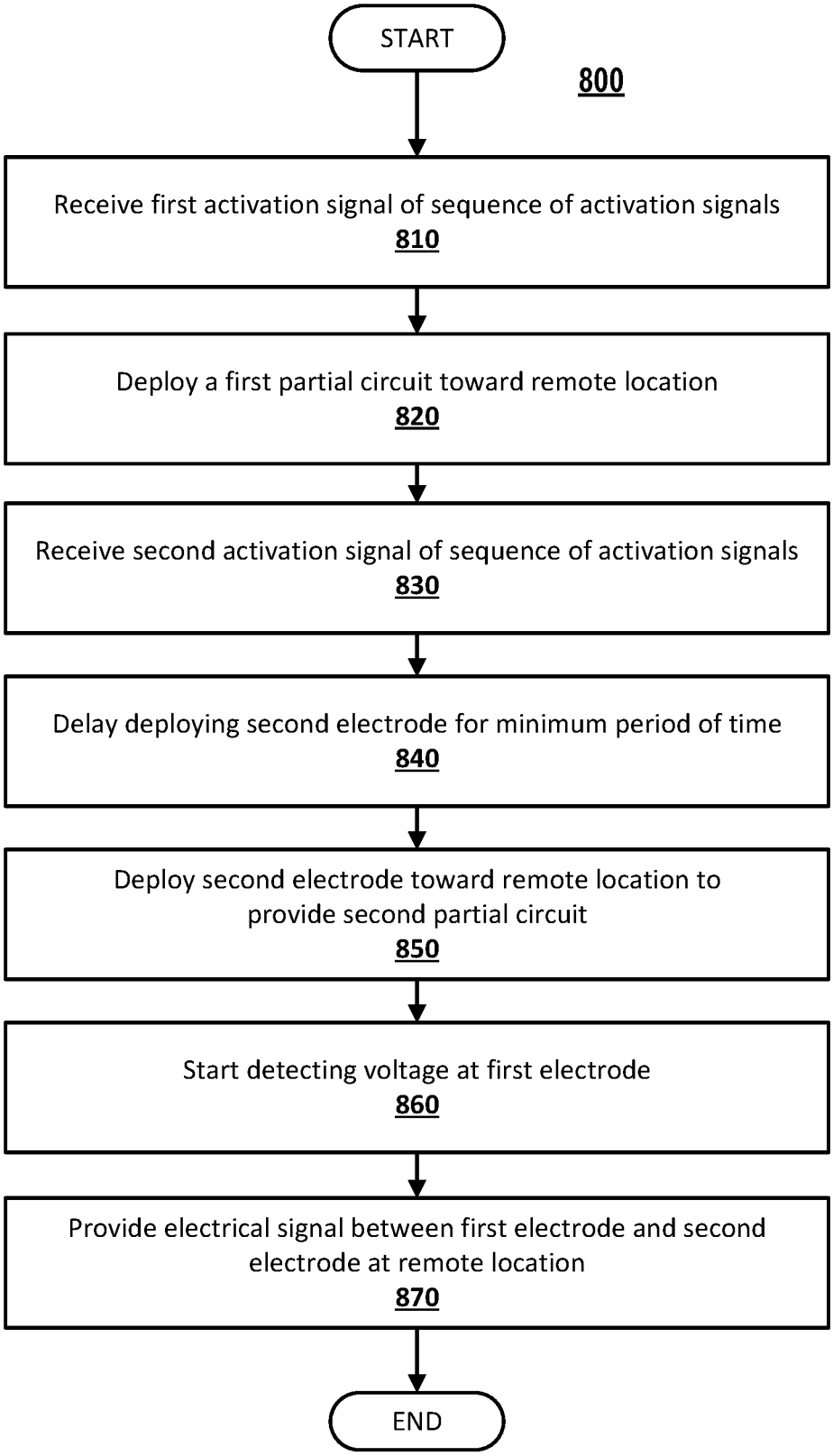
FIG. 8 illustrates a process flow for a method of deploying a partial circuit in accordance with various embodiments.

In various embodiments, and with reference to FIG. 8, a process flow (e.g., flowchart) of a method for deploying a partial circuit is disclosed. The process flow for method 800 depicts one combination of blocks that may be implemented in accordance with one embodiment. Those of ordinary skill in the art will realize that method 800 and/or any other implementations herein may utilize additional and/or fewer blocks, components, and/or systems (including those discussed with respect to other figures and/or known in the art). Further, absent expressly indicating otherwise, the ordering of describing various implementations and blocks is merely for illustrative purposes and not intended to limit the scope of this disclosure. As understood by a person of ordinary skill in the art, a computer-readable medium comprising computer-executable instructions that are configured to be executed by a processor to perform one or more processes disclosed herein. In embodiments, method 800 may be performed by a CEW. For example, method 800 may be implemented by CEW 100 and/or CEW 200 and/or CEW 600 (with brief reference to FIGS. 1-3, and 6). In embodiments, one or more operations of method 800 may be performed by a component of a CEW. For example, one or more operations of method 800 may be performed by a processing circuit (e.g., processing circuit 110 or processing circuit 410 with brief reference to FIGS. 1 and 4) and/or a control circuit (e.g., control circuit 400 with brief reference to FIG. 4).

In various embodiments, deploying a partial circuit may include operations comprising receiving first activation signal of sequence of activation signals 810, deploying a first partial circuit toward remote location 820, receiving second activation signal of sequence of activation signals 830, delaying deploying second electrode for minimum period of time 840, deploying second electrode toward remote location to provide second partial circuit 850, starting detecting voltage at first electrode 860, and providing electrical signal between first electrode and second electrode at remote location 870.

Receiving first activation signal of sequence of activation signals 810 may comprise a processing circuit of a conducted electrical weapon configured to receive the first activation signal via the user control interface. The first activation signal may comprise a single first activation signal. The processing circuit may be configured to receive the first activation signal via a same user control interface as the second activation signal. For example, receiving the first activation signal may comprise receiving first activation signal 210-1 and/or first activation signal 610-1 with brief reference to FIGS. 2 and 6.

Deploying a first partial circuit toward remote location 820 may comprise deploying, by the processing circuit of the conducted electrical weapon, the first partial circuit toward the remote location in response to the first activation signal of the sequence of activation signals. The first partial circuit may comprise the first electrode. The first partial circuit may comprise a single conductive signal path between the conducted electrical weapon and the remote location. Prior to the second activation signal, the first partial circuit is configured to provide an open-circuit voltage between the conducted electrical weapon and the remote location. The open circuit voltage may be provided between the remote location and an output of a signal generator of the conducted electrical weapon. The open circuit voltage may be provided between the first partial circuit and an output of a signal generator of the conducted electrical weapon that is not conductively coupled to the remote location. A second conductive signal path may not be deployed from the conducted electrical weapon in response to the first activation signal. A second conductive signal path may not be provided to the remote location in response to the first activation signal. Deploying the partial circuit may comprise decoupling, by the processing circuit, the first electrode from the signal generator during a first period of time between a first time at which the first electrode is deployed and a second time at which a second electrode is deployed. The first partial circuit may comprise a single conductive signal path between the conducted electrical weapon and the first electrode at the remote location. For example, deploying a first partial circuit toward remote location 820 may comprise a processing circuit of CEW 200 or 600 deploying first electrode 230-1 and first filament 232-1 and/or first electrode 630-1 and first filament 632-1 with brief reference to FIGS. 2 and 6.

In embodiments, the electrical signal may comprise a first voltage and a second voltage. The electrical signal may comprise a stimulus signal. The electrical signal may be determined in accordance with the first voltage and the second voltage. For example, the electrical signal may comprise a current determined in accordance with providing the first voltage and the second voltage to a load. One or more of a group comprising the first voltage and second voltage may be retained at the conducted electrical weapon in response to the first activation signal of the series of activation signals. In embodiments, deploying the first partial circuit may comprise providing at least a third conductive signal path between the conducted electrical weapon and the remote location. For example, two or more conductive signal paths may have been previously deployed to the remote location; however, the deploying of the first partial circuit may remain insufficient itself to deliver current at the remote location.

Receiving second activation signal of sequence of activation signals 830 may comprise the processing circuit further configured to receive the first activation signal. The first activation signal may comprise a single first activation signal. For example, receiving second activation signal of sequence of activation signals 830 may comprise a processing circuit of CEW 200 receiving second activation signal 210-2 and/or second activation signal 610-2 with brief reference to FIGS. 3 and 6.

Delaying second electrode for minimum period of time 840 may comprise delaying, by the processing circuit, the deploying of the second electrode for a minimum period of time. A second period of time at which the second electrode is deployed may be equal or greater than the minimum period of time. The minimum period of time may be between 50 milliseconds and 100 milliseconds. The processing circuit may be configured to delay deployment of the second electrode for a minimum period of time after the first partial circuit is deployed. The processing circuit may be configured to enable deployment of the second electrode after the minimum period of time has elapsed. For example, processing circuit 110 and/or processing circuit 410 may delay providing an ignition signal to second electrode 130-2 and/or second electrode 430-2 with brief reference to FIGS. 1 and 4.

Deploying second electrode toward remote location to provide second partial circuit 850 may comprise deploying, by the processing circuit, the second electrode toward the remote location to provide the second partial circuit. The second electrode may be deployed in response to the second activation signal of the sequence of activation signals. Deploying the second electrode may comprise deploying the second electrode a second period of time after the first partial circuit is deployed. The second period of time may be equal or greater than a first period of time during which deploying the second electrode toward remote location to provide second partial circuit 850 may be prevented by the processing circuit. For example, deploying second electrode toward remote location to provide second partial circuit 850 may comprise deploying second electrode 230-2 and second filament 232-2 and/or second electrode 630-2 and second filament 632-2 with brief reference to FIGS. 2 and 6.

Starting detecting voltage at first electrode 860 may comprise detecting a voltage of the electrical signal at the first electrode starting after the first partial circuit is deployed and the second electrode is deployed. A voltage detector of the conducted electrical weapon may be configured to detect a voltage at the first electrode starting after the first partial circuit is deployed and the second electrode is deployed. For example, starting detecting voltage at first electrode 860 may comprise processing circuit 410 initiating acquisition of voltages detected by voltage detector 460 and/or activating voltage detector 460 with brief reference to FIG. 4.

Providing electrical signal between first electrode and second electrode at remote location 870 may comprise providing, by the signal generator of the conducted electrical weapon, the electrical signal between the first electrode and the second electrode, wherein the second partial circuit enables the electrical signal to be provided at the remote location via the first partial circuit. Enabling the signal to be provided may include enabling a closed circuit to be formed between a signal generator of the conducted electrical weapon and a load at the remote location via at least two partial circuits between the conducted electrical weapon and the remote location. Enabling the signal to be provided may include providing a minimum number of conductive signal paths between the conducted electrical weapon and the remote location. Enabling the signal via the first partial circuit is independent of whether an electrode of the circuit conductively couples to an object at the remote location. Even if all electrodes deployed in response to the first activation signal conductively couple to an object at the remote location, the electrical elements deployed from the conducted electrical weapon in response to the first activation signal may not be configured to provide a current at the remote location in accordance with a configuration of these electrical elements. Additional electrical elements (e.g., another conductive signal path between the conducted electrical weapon) may be required before remote delivery of current is electrically enabled (e.g., possible) via the first partial signal path. The first partial circuit may be unable to provide the electrical signal in accordance with a configuration of the elements of the first partial circuit. Providing the electrical signal may include providing the electrical signal between the first electrode and the second electrode after each of the first electrode is deployed and the second electrode is deployed. Providing the electrical signal may include coupling the signal generator to the first partial circuit before or after providing the electrical signal to the second electrode. Providing the electrical signal may include coupling the electrical signal to the first partial circuit and the second partial circuit starting at a same time.

Figure 9:
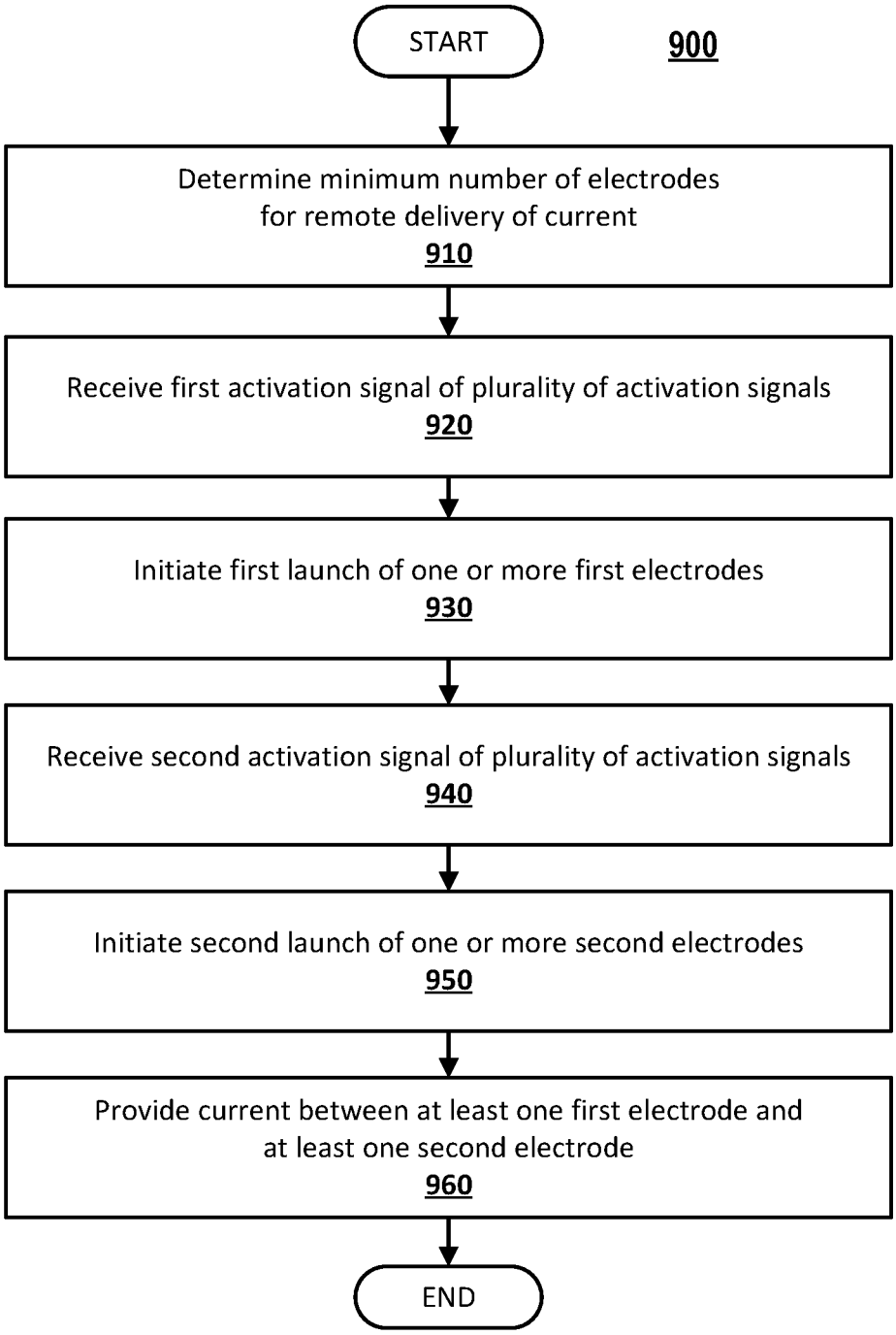
FIG. 9 illustrates a process flow for a method of deploying a minimum number of electrodes in accordance with various embodiments.

In various embodiments, and with reference to FIG. 9, a flowchart of a method for deploying a minimum number of electrodes is disclosed. A process flow (e.g., flowchart) of method 900 depicts one combination of blocks that may be implemented in accordance with one embodiment. Those of ordinary skill in the art will realize that method 900 and/or any other implementations herein may utilize additional and/or fewer blocks, components, and/or systems (including those discussed with respect to other figures and/or known in the art). Further, absent expressly indicating otherwise, the ordering of describing various implementations and blocks is merely for illustrative purposes and not intended to limit the scope of this disclosure. As understood by a person of ordinary skill in the art, a computer-readable medium comprising computer-executable instructions that are configured to be executed by a processor to perform one or more processes disclosed herein. In embodiments, method 900 may be performed by a CEW. For example, method 900 may be implemented by CEW 100 and/or CEW 200 and/or CEW 600 (with brief reference to FIGS. 1-2 and 6). In embodiments, one or more operations of method 900 may be performed by a component of a CEW. For example, one or more operations may be performed by a processing circuit (e.g., processing circuit 110 or processing circuit 410 with brief reference to FIGS. 1 and 4) and/or a control circuit (e.g., control circuit 400 with brief reference to FIG. 4).

In various embodiments, deploying a minimum number of electrodes may include operations comprising determining a minimum number of electrodes for remote delivery of current 910, receiving first activation signal of plurality of activation signals 920, initiating first launch of one or more first electrodes 930, receiving second activation signal of plurality of activation signals 940, initiating second launch of one or more second electrodes 950, and providing current between at least one first electrode and at least one second electrode 960.

In embodiments, determining a minimum number of electrodes for remote delivery of current 910 may comprise determining the minimum number in accordance with an electrical configuration of internal circuits of the conducted electrical weapon. Determining the number may providing a signal generator and coupling a single output signal of the signal generator to each electrode of the conducted electrical weapon. The signal generator may generate a plurality of voltages for remote delivery of the current. The minimum number may be determined in accordance with a second number of different voltages generated by the signal generator for the remote delivery of the current. For example, the second number may be two. The minimum number may be determined in accordance with a third number of the different voltages to which each electrode of the one or more first electrodes and the one or more second electrodes is respectively configured to be coupled at a same time. For example, the third number may be one. The minimum number may be further determined in accordance with a number of electrodes deployed in each launch in a sequence of launches. For example, a first launch may comprise two electrodes each coupled to a same voltage provided by a signal generator. The minimum number of electrodes may comprise at least a third electrode coupled to another voltage provided by the signal generator in order to deliver current in accordance with a difference in voltage between the same voltage and the other voltage. Accordingly, and in embodiments, the minimum number may be greater than two. For example, a conducted electrical weapon comprising control circuit 400 may have a minimum number of two.

In embodiments, receiving first activation signal of plurality of activation signals 920 may comprise receiving, by the processing circuit, the first activation signal via a control interface of the conducted electrical weapon. The plurality of first electrodes may be deployed after the first activation signal is received.

In embodiments, initiating first launch of one or more first electrodes 930 may comprise initiating, by the processing circuit of the conducted electrical weapon, the first launch of one or more first electrodes responsive to the first activation signal of the plurality of activation signals. The one or more second electrodes may include a plurality of electrodes.

In embodiments, receiving second activation signal of plurality of activation signals 940 may comprise receiving, by the processing circuit, the second activation signal via the control interface.

In embodiments, initiating second launch of one or more second electrodes 950 may comprise initiating, by the processing circuit of the conducted electrical weapon, the second launch of one or more second electrodes responsive to the second activation signal of the plurality of activation signals. The second number of the plurality of electrodes may be greater than the minimum number. The second launch may be initiated prior to the first launch. The second launch may be initiated after the first launch. Each electrode of the one or more first electrodes and each electrode of the one or more second electrodes may be respectively coupled to the conducted electrical weapon via a different conductive filament. A second number of the one or more second electrodes may be less than the minimum number.

In embodiments, providing current between at least one first electrode and at least one second electrode 960 may comprise providing, by the signal generator of the conducted electrical weapon, the current between the at least one first electrode of the one or more first electrodes and the at least one second electrode of the one or more second electrodes. A first number of the one or more first electrodes may be less than the minimum number of electrodes required by the conducted electrical weapon for remote delivery of the current. For example, first launch 234-1 may comprise one electrode, first electrode 430-1, which may be less than a minimum number required by control circuit 400 with brief reference to FIGS. 2 and 4. The first number may be one. In embodiments, the current may be provided between the at least two second electrodes of the plurality of electrodes prior to the first launch.

Figure 10:
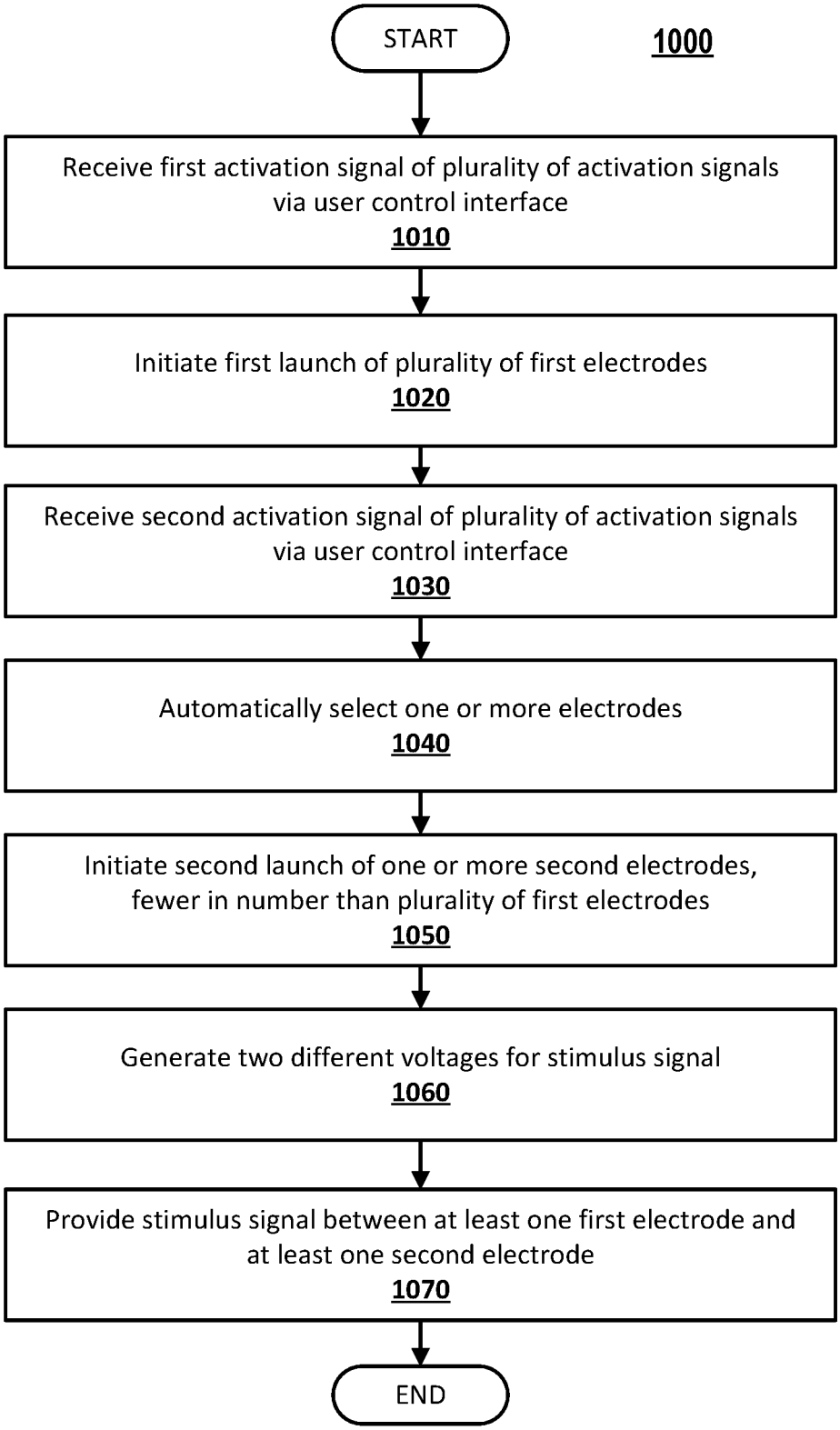
FIG. 10 illustrates a process flow for a method of deploying a plurality of electrodes in accordance with various embodiments.

In various embodiments, and with reference to FIG. 10, a process flow of a method for deploying a plurality of electrodes disclosed. A process flow (e.g., flowchart) of method 1000 depicts one combination of blocks that may be implemented in accordance with one embodiment. Those of ordinary skill in the art will realize that method 1000 and/or any other implementations herein may utilize additional and/or fewer blocks, components, and/or systems (including those discussed with respect to other figures and/or known in the art). Further, absent expressly indicating otherwise, the ordering of describing various implementations and blocks is merely for illustrative purposes and not intended to limit the scope of this disclosure. As understood by a person of ordinary skill in the art, a computer-readable medium comprising computer-executable instructions that are configured to be executed by a processor to perform one or more processes disclosed herein. In embodiments, method 1000 may be performed by a CEW. For example, method 1000 may be implemented by CEW 100 and/or CEW 200 and/or CEW 600 (with brief reference to FIGS. 1, 2, and 6). In embodiments, one or more operations of method 1000 may be performed by a component of a CEW. For example, one or more operations may be performed by a processing circuit (e.g., processing circuit 110 or processing circuit 410 with brief reference to FIGS. 1 and 4) and/or a control circuit (e.g., control circuit 400 with brief reference to FIG. 4).

Deploying a plurality of electrodes may include operations comprising receiving a first activation signal of plurality of activation signals via user control interface 1010, initiating first launch of plurality of first electrodes 1020, receiving second activation signal of plurality of activation signals via a user control interface 1030, automatically selecting one or more electrodes, initiating second launch of one or more second electrodes that are fewer in number than plurality of first electrodes 1050, generating two different voltages for a stimulus signal 1060, and providing the stimulus signal between at least one first electrode and at least one second electrode 1070.

Receiving the first activation signal of the plurality of activation signals via a user control interface 1010 may include receiving, by a processing circuit of a conducted electrical weapon, the first activation signal via the user control interface.

In embodiments, initiating first launch of plurality of first electrodes 1020 may include deploying at least two first electrodes. The one or more first wire-tethered electrodes may comprise at least two first wire-tethered electrodes. In embodiments, at least three electrodes may be deployed. The electrodes may include a plurality of wire-tethered electrodes. For example, second electrode 230-2 and third electrode 230-3 of electrodes 230 of FIG. 3 may be deployed in response to an activation signal (e.g., second activation signal 210-2) and/or part of a same launch (e.g., second launch 234-2). Initiating the first launch may include initiating launch of first wire-tethered electrodes of a plurality of wire-tethered electrodes toward a remote location in response to the first activation signal of the plurality of activation signals. The at least two first electrodes may be simultaneously deployed in response to detecting a first actuation of a control device of the conducted electrical weapon.

Receiving second activation signal of the plurality of activation signals via a user control interface 1030 may include the processing circuit receiving the second activation signal. The second activation signal may be received via the user control interface. The user control interface may include a trigger and/or a same interface by which the first activation signal is received. The second activation signal may be received before the first activation signal.

Automatically selecting one or more electrodes 1040 may include configuring a selector circuit. For example, a processing circuit may control one or more switches between a signal generator and the one or more control signals after a first launch. The processing circuit may control the switches to conductively couple the signal generator to one or more electrodes to enable a next ignition signal to be provided from the signal generator to the one or more electrodes. The next ignition signal may be generated in response to a next activation signal. The one or more electrodes may be automatically selected by the processing circuit prior to receiving a next activation signal in a sequence of activation signals. The one or more electrodes may be automatically selected after the first launch and prior to the second activation signal of the sequence of activation signals. A next set of wire-tethered electrodes of the plurality of wire-tethered electrodes may be automatically selected, wherein the next set of wire-tethered electrodes is automatically selected after the first launch and prior to the second activation signal of the plurality of activation signals.

Initiating second launch of one or more second electrodes that are fewer in number than plurality of first electrodes 1050 may include deploying the one or more second electrodes from a CEW. The one or more second electrodes may comprise one second electrode. For example, a solitary or single electrode may be deployed. For example, first electrode 230-1 of electrodes 230 of FIG. 2 may be deployed in response to an activation signal (e.g., first activation signal 210-1) and/or part of a same launch (e.g., second launch 234-1). The one or more second wire-tethered electrodes may comprise a single second wire-tethered electrode. A number of the one or more second wire-tethered electrodes may be one. The second launch may be initiated in accordance with a next set of wire-tethered electrodes, wherein the next set of wire-tethered electrodes comprises the one or more second wire-tethered electrodes. In embodiments, the one or more second electrodes may be deployed after the one or more first electrodes are deployed. The first launch may be before or after the second launch.

Generating two different voltages for a stimulus signal 1060 may include a signal generator generating the two different voltages. The different voltages may be provided as different output signals from a signal generator on separate conductive signal paths within CEW. A current may be provided at a remote location in accordance with a difference between the different voltages. A control signal may be transmitted by the processing circuit to the signal generator to provide the stimulus signal from the signal generator.

Providing the stimulus signal between at least one first electrode and at least one second electrode 1070 may include coupling different voltages from a signal generator to the at least one first electrode and at least one second electrode. For example, output signals comprising the different voltages may be coupled to two or more different electrodes. A processing circuit may control a selector circuit to conductively couple the signal generator to the two or more electrodes. The selector circuit may electrically couple the two different voltages to the two or more electrodes. Providing the stimulus signal may comprise applying the two different voltages to the plurality of first electrodes. Providing the stimulus signal may enable remote delivery of a current from a conducted electrical weapon. Providing the stimulus signal may comprise applying one voltage of the two different voltages to the one or more second electrodes. Providing the stimulus signal may comprise applying a second voltage of the two different voltages to the plurality of first electrodes, wherein the second voltage is different from the one voltage. Providing the stimulus signal may comprise applying at least one voltage generated by the signal generator to the plurality of first electrodes prior to initiating the second launch. The stimulus signal may be initially provided to the one more second electrodes after the first launch and the second launch, wherein the first launch is after the second launch.

In embodiments, providing the stimulus signal between at least one first electrode and at least one second electrode 1070 may alternately or additional comprise conducting, by the conducted electrical weapon, an electrical signal at a remote location from a signal generator of the conducted electrical weapon via at least one first wire-tethered electrode of the first wire-tethered electrodes and the second single wire-tethered electrode. Conducting, by the conducted electrical weapon, may include conducting a second electrical signal from the signal generator via the first wire-tethered electrodes prior to the second actuation, wherein the second electrical signal is conducted between the first wire-tethered electrodes at the remote location.

According to various aspects of the present disclosure, an example method of deploying electrodes may be provided. The example method may comprise deploying, by a conducted electrical weapon, a single first electrode in response to a first activation signal of a sequence of activation signals. The example method may further comprise deploying, by the conducted electrical weapon, a second electrode in response to a second activation signal of the sequence of activation signals. The example method may further comprise providing, by a signal generator of the conducted electrical weapon, a stimulus signal between the single first electrode and the second electrode. In the example method, the single first electrode may comprise a single wire-tethered electrode. In one or more of the preceding example methods, the first activation signal may comprise a single first activation signal. One or more preceding example methods may further comprise detecting, by a processing circuit of the conducted electrical weapon, the first activation signal. One or more of the preceding example methods may further comprise detecting, by the processing circuit of the conducted electrical weapon, the second activation signal. In one or more of the preceding example methods, the first activation signal may be detected from a user control interface in communication with the processing circuit and the second activation signal is detected from the user control interface. In one or more of the preceding example methods, deploying the second electrode may include deploying a single second electrode. In one or more of the preceding example methods, the second activation signal may comprise a single second activation signal. In one or more of the preceding example methods, the single first electrode may be deployed toward a remote location at a first angle of deployment relative to the remote location and the second electrode may be deployed toward the remote location at a second angle of deployment relative to the remote location, and the first angle of deployment may be independent of the second angle of deployment. In one or more of the preceding example methods, the single first electrode may be deployed from the conducted electrical weapon at a first launch angle, and the second electrode may be deployed from the conducted electrical weapon at a second launch angle, and the first launch angle may be equal to the second launch angle. In one or more of the preceding example methods, the single first electrode may be deployed from the conducted electrical weapon at a first location on the conducted electrical weapon, and the second electrode may be deployed from the conducted electrical weapon at a second location on the conducted electrical weapon. A spacing between the first location and the second location may be less than 0.5 inches. A spacing between the first location and the second location may be less than 1.0 inches.

According to various aspects of the present disclosure, an example conducted electrical weapon may be provided. The conducted electrical weapon may comprise a signal generator configured to generate a stimulus signal. The conducted electrical weapon may comprise a plurality of wire-tethered electrodes. The conducted electrical weapon may comprise a processing circuit configured to deploy the plurality of wire-tethered electrodes from the conducted electrical weapon and provide the stimulus signal across the plurality of wire-tethered electrodes. The processing circuit may be configured to deploy a single first electrode of the plurality of wire-tethered electrodes in response to a first activation signal of a sequence of activation signals. The processing circuit may be configured to deploy a second electrode of the plurality of wire-tethered electrodes in response to a second activation signal of the sequence of activation signals. The processing circuit may be configured to couple the signal generator across the single first electrode and the second electrode to provide the stimulus signal. In the example conducted electrical weapon, the processing circuit may be further configured to receive the first activation signal, and wherein the first activation signal may comprise a single first activation signal. One or more of the above example conducted electrical weapons may further comprise a user control interface, wherein the single first activation signal may be received by the processing circuit via the user control interface. In one or more of the above example conducted electrical weapons, the processing circuit may be further configured to receive the second activation signal via the user control interface, wherein the second activation signal comprises a single second activation signal. In one or more of the above example conducted electrical weapons, the single first electrode may be configured to launch from the conducted electrical weapon at a first angle relative to the conducted electrical weapon, wherein the second electrode may be configured to launch from the conducted electrical weapon at a second angle relative to the conducted electrical weapon, and wherein the first angle may be parallel to the second angle. In one or more of the above example conducted electrical weapons, the single first electrode may be configured to launch from the conducted electrical weapon at a first location on the conducted electrical weapon, wherein the second electrode may be configured to launch from the conducted electrical weapon at a second location, and wherein a spacing between the first location and the second location may be less than 0.5 inches.

According to various aspects of the present disclosure, an example method of deploying electrodes may be provided. The method may comprise deploying, by a conducted electrical weapon, a single first electrode from the conducted electrical weapon in response to a single first activation signal of a sequence of activation signals. The method may comprise deploying, by the conducted electrical weapon, a single second electrode from the conducted electrical weapon in response to a single second activation signal of the sequence of activation signals. The method may comprise providing, by a signal generator of the conducted electrical weapon, a stimulus signal via the single first electrode and the single second electrode. Deploying the single first electrode may include deploying the single first electrode at a first angle of deployment, deploying the single second electrode may include deploying the single second electrode at a second angle of deployment, and the first angle of deployment may be independent of the second angle of deployment. Providing the stimulus signal may include providing the stimulus signal from the signal generator across the single first electrode and the single second electrode after each of the single first electrode and the single second electrode are deployed from the conducted electrical weapon.

In embodiments according to various aspects of the present disclosure, a method may be provided. The method may comprise deploying, by a processing circuit of a conducted electrical weapon, a first partial circuit toward a remote location in response to a first activation signal of a sequence of activation signals, wherein the first partial circuit comprises a first electrode. The method may comprise deploying, by the processing circuit, a second electrode toward the remote location to provide a second partial circuit, wherein the second electrode is deployed in response to a second activation signal of the sequence of activation signals. The method may comprise providing, by a signal generator of the conducted electrical weapon, an electrical signal between the first electrode and the second electrode, wherein the second partial circuit enables the electrical signal to be provided at the remote location via the first partial circuit. The first partial circuit may comprise a single conductive signal path between the conducted electrical weapon and the remote location. Prior to the second activation signal, the first partial circuit may be configured to provide an open-circuit voltage between the conducted electrical weapon and the remote location. The method may further comprise decoupling, by the processing circuit, the first electrode from the signal generator during a first period of time between a first time at which the first electrode is deployed and a second time at which the second electrode is deployed. The electrical signal may comprise a first voltage and a second voltage. One or more of a group comprising the first voltage and second voltage may be retained at the conducted electrical weapon in response to the first activation signal of the series of activation signals. Deploying the second electrode comprises deploying the second electrode a second period of time after the first partial circuit is deployed. Deploying the second electrode may comprises preventing the deploying of the second electrode for a minimum period of time. The second period of time may be equal or greater than the minimum period of time. The minimum period of time may be between 50 milliseconds and 100 milliseconds. Providing the electrical signal may include providing the electrical signal between the first electrode and the second electrode after each of the first electrode is deployed and the second electrode is deployed. Providing the electrical signal may include coupling the signal generator to the first partial circuit before or after providing the electrical signal to the second electrode. Providing the electrical signal may include coupling the electrical signal to the first partial circuit and the second partial circuit starting at a same time. Deploying the first partial circuit may comprises providing at least a third conductive signal path between the conducted electrical weapon and the remote location. The method may further comprise detecting a voltage of the electrical signal at the first electrode, wherein the voltage is detected starting after the first partial circuit is deployed and the second electrode is deployed.

In embodiments according to various aspects of the present disclosure, a conducted electrical weapon may be provided. The conducted electrical weapon may comprise a signal generator configured to generate a stimulus signal. The conducted electrical weapon may comprise a plurality of wire-tethered electrodes. The conducted electrical weapon may comprise a processing circuit configured to deploy the plurality of wire-tethered electrodes from the conducted electrical weapon and provide the stimulus signal across the plurality of wire-tethered electrodes. The processing circuit may deploy a first partial circuit toward a remote location in response to a first activation signal of a sequence of activation signals, wherein the partial circuit comprises a first electrode of the plurality of wire-tethered electrodes. The processing circuit may deploy a second electrode of the plurality of wire-tethered electrodes toward the remote location to provide a second partial circuit, wherein the second electrode is deployed in response to a second activation signal of the sequence of activation signals. The processing circuit may provide the stimulus signal between the first electrode and the second electrode, wherein the second partial circuit enables the stimulus signal to be provided at the remote location via the first partial circuit. The first partial circuit may comprise a single conductive signal path between the conducted electrical weapon and the first electrode at the remote location. The processing circuit may be further configured to delay deployment of the second electrode for a minimum period of time after the first partial circuit is deployed. The processing circuit may be further configured to enable deployment of the second electrode after the minimum period of time has elapsed. The conducted electrical weapon may further comprise a selector circuit, wherein the processing circuit is configured to control the selector circuit to couple the first partial circuit to the signal generator after the first partial circuit is deployed and the second electrode is deployed. The conducted electrical weapon may further comprise a voltage detector configured to detect a voltage at the first electrode starting after the first partial circuit is deployed and the second electrode is deployed.

In embodiments according to various aspects of the present disclosure, a method may be provided. The method may comprise deploying, by a processing circuit of a conducted electrical weapon, a first partial circuit toward a remote location in response to a first activation signal of a sequence of activation signals, wherein the partial circuit comprises a first wire-tethered electrode. The method may comprise deploying, by the processing circuit, a second wire-tethered electrode toward the remote location to provide a second partial circuit, wherein the second wire-tethered electrode is deployed in response to a second activation signal of the sequence of activation signals. The method may comprise conducting, by a signal generator of the conducted electrical weapon, a stimulus current at the remote location, wherein the stimulus current is conducted between the first wire-tethered electrode and the second wire-tethered electrode, and wherein the first partial circuit is prevented from providing the stimulus current at the remote location unless the second wire-tethered electrode is deployed. The method may comprise coupling the first wire-tethered electrode to the signal generator to provide the stimulus current after the second wire-tethered is deployed.

In embodiments according to various aspects of the present disclosure, a method may be provided. The method may comprise initiating, by a processing circuit of a conducted electrical weapon, a first launch of one or more first electrodes responsive to a first activation signal of a plurality of activation signals. The method may comprise initiating, by the processing circuit of the conducted electrical weapon, a second launch of one or more second electrodes responsive to a second activation signal of the plurality of activation signals. The method may comprise providing, by a signal generator of the conducted electrical weapon, a current between at least one first electrode of the one or more first electrodes and at least one second electrode of the one or more second electrodes, wherein a first number of the one or more first electrodes is less than a minimum number of electrodes required by the conducted electrical weapon for remote delivery of the current. The minimum number may be determined in accordance with a second number of different voltages generated by the signal generator for the remote delivery of the current and a third number of the different voltages to which each electrode of the one or more first electrodes and the one or more second electrodes is respectively configured to be coupled at a same time. The second number may be two. The third number may be one. The first number may be one. The minimum number may be greater than two. The one or more second electrodes may include a plurality of electrodes. A second number of the plurality of electrodes may be greater than the minimum number. The second launch may be initiated prior to the first launch. The method may further comprise providing, by the signal generator, the current between at least two second electrodes of the plurality of electrodes prior to the first launch. Each electrode of the one or more first electrodes and each electrode of the one or more second electrodes may be respectively coupled to the conducted electrical weapon via a different conductive filament. A second number of the one or more second electrodes may be less than the minimum number. The first launch may be initiated prior to the second launch.

In embodiments according to various aspects of the present disclosure, a conducted electrical weapon may be provided. The conducted electrical weapon may comprise a signal generator configured to generate a first voltage and a second voltage for remote delivery of a stimulus current. The conducted electrical weapon may comprise a plurality of electrodes comprising one or more first electrodes and one or more second electrodes. The conducted electrical weapon may comprise a processing circuit configured to launch the plurality of electrodes and electrically couple the plurality of electrodes to the signal generator. The processing circuit may provide one or more first ignition signals to initiate a first launch of the one or more first electrodes responsive to a first activation signal of a plurality of activation signals. The processing circuit may provide one or more second ignition signals to initiate a second launch of the one or more second electrodes responsive to a second activation signal of the plurality of activation signals. The processing circuit may remotely deliver the stimulus current between at least one first electrode of the one or more first electrodes and at least one second electrode of the one or more second electrodes, wherein the first launch provides less than a minimum number of electrodes required by the conducted electrical weapon for the remote delivery of the stimulus current. The one or more first electrodes may comprise only one electrode and the minimum number may be determined to be two in accordance with the only one electrode being further configured to conduct one voltage at a time of either the first voltage or the second voltage. The processing circuit may be configured to deploy the only one electrode prior to the second launch. Each electrode of plurality of electrodes may be configured to provide a respective, single electrically conductive path for the stimulus current. The processing circuit may be further configured to initially couple the first voltage and the second voltage to the plurality of electrodes after the first launch and the second launch.

In embodiments according to various aspects of the present disclosure, a handle of a conducted electrical weapon may be provided. The handle may comprise a user control interface. The handle may comprise a signal generator configured to generate a first voltage and a second voltage for remote delivery of a stimulus signal. The handle may comprise a processing circuit configured to launch a plurality of provided electrodes and electrically couple the plurality of provided electrodes to the signal generator. The processing circuit may be configured to provide one or more first ignition signals to initiate a first launch of one or more first provided electrodes of the provided plurality of electrodes responsive to an activation signal received via the user control interface. The processing circuit may be configured to provide one or more second ignition signals to initiate a second launch of one or more provided second electrodes of the provided plurality of electrodes responsive to another activation signal received via the user control interface. The processing circuit may be configured to couple the first voltage and the second voltage across at least one first provided electrode of the one or more first provided electrodes and at least one second provided electrode of the one or more second provided electrodes, wherein, in accordance with the one or more first ignition signals, the first launch provides less than a minimum number of electrodes required by the conducted electrical weapon for the remote delivery of the stimulus signal. The minimum number may be two. The one or more first ignition signals may comprise a single ignition signal. The processing circuit may be configured to provide the single ignition signal to a single provided electrode of the plurality of provided electrodes.

According to various aspects of the present disclosure, a method may be provided. The method may comprise initiating, by a processing circuit of a conducted electrical weapon, a first launch of a plurality of first electrodes toward a remote location in response to a first activation signal of a sequence of activation signals. The method may comprise initiating, by the processing circuit, a second launch of one or more second electrodes toward the remote location in response to a second activation signal of the sequence of activation signals. The method may comprise providing, by a signal generator of the conducted electrical weapon, a stimulus signal via at least one first electrode of the plurality of first electrodes and at least one second electrode of the one or more second electrodes, wherein the one or more second electrodes are fewer in number than the plurality of first electrodes. The one or more second electrodes may comprise one second electrode. The one or more first electrodes may comprise at least three first electrodes. The one or more second electrodes may be deployed after the one or more first electrodes are deployed. The method may further comprise receiving, by the processing circuit, the second activation signal via a control interface of the conducted electrical weapon, wherein the plurality of first electrodes is deployed after the second activation signal is received. The method may further comprise receiving, by the processing circuit, the first activation signal via the control interface. The method may further comprise automatically selecting, by the processing circuit, the one or more second electrodes after the first launch and prior to the second activation signal of the sequence of activation signals. The method may further comprise generating, by the signal generator, two different voltages for the stimulus signal, wherein providing the stimulus signal comprises applying one voltage of the two different voltages to the one or more second electrodes. Providing the stimulus signal may comprise applying the two different voltages to the plurality of first electrodes. Providing the stimulus signal may comprises applying a second voltage of the two different voltages to the plurality of first electrodes, wherein the second voltage is different from the one voltage. Providing the stimulus signal may comprises applying at least one voltage generated by the signal generator to the plurality of first electrodes prior to initiating the second launch. The stimulus signal may be initially provided to the one more second electrodes after the first launch and the second launch, and wherein the first launch is after the second launch.

According to various aspects of the present disclosure, a conducted electrical weapon may be provided. The conducted electrical weapon may comprise a signal generator configured to generate a stimulus signal. The conducted electrical weapon may comprise a plurality of wire-tethered electrodes. The conducted electrical weapon may comprise a user control interface configured to receive a plurality of activation signals. The conducted electrical weapon may comprise a processing circuit configured to deploy the plurality of wire-tethered electrodes from the conducted electrical weapon and provide the stimulus signal across the plurality of wire-tethered electrode. The processing circuit may be configured to initiate a first launch of first wire-tethered electrodes of the plurality of wire-tethered electrodes toward a remote location in response to a first activation signal of the plurality of activation signals. The processing circuit is configured to initiate a second launch of one or more second wire-tethered electrodes of the plurality of wire-tethered electrodes toward the remote location in response to a second activation signal of the plurality of activation signals. The processing circuit is configured to provide the stimulus signal via at least one first wire-tethered electrode of the plurality of first wire-tethered electrodes and at least one second wire-tethered electrode of the one or more second wire-tethered electrodes, wherein a second number of the one or more second wire-tethered electrodes may be less than a first number of the plurality of first wire-tethered electrodes. The one or more second wire-tethered electrodes may comprise a single second wire-tethered electrode and the second number is one. The one or more first wire-tethered electrodes may comprise at least two first wire-tethered electrodes. The processing circuit may be further configured to automatically select a next set of wire-tethered electrodes of the plurality of wire-tethered electrodes. The next set of wire-tethered electrodes may be automatically selected after the first launch and prior to the second activation signal of the plurality of activation signals. The processing circuit is configured to initiate the second launch in accordance with the next set of wire-tethered electrodes, wherein the next set of wire-tethered electrodes comprises the one or more second wire-tethered electrodes. The stimulus signal may comprise two different voltages for the stimulus signal. Providing the stimulus signal may comprise applying one voltage of the two different voltages to the one or more second electrodes.

According to various aspects of the present disclosure, a method may be provided. The method may comprise simultaneously deploying, by a conducted electrical weapon, first wire-tethered electrodes toward a remote location in response to detecting a first actuation of a control device of the conducted electrical weapon. The method may comprise deploying, by the conducted electrical weapon, a single second electrode toward the remote location in response to detecting a second actuation of the control device of the conducted electrical weapon. The method may comprise conducting, by the conducted electrical weapon, an electrical signal from a signal generator of the conducted electrical weapon at the remote location via at least one first wire-tethered electrode of the first wire-tethered electrodes and the second single wire-tethered electrode. The single second wire-tethered electrode is deployed after the first wire-tethered electrodes are deployed. The method may further comprise conducting, by the conducted electrical weapon, a second electrical signal from the signal generator via the first wire-tethered electrodes prior to the second actuation, wherein the second electrical signal is conducted between the first wire-tethered electrodes at the remote location.

The foregoing description discusses implementations (e.g., embodiments), which may be changed or modified without departing from the scope of the present disclosure. An embodiment or embodiments discussed in the foregoing description may be combined with another embodiment or other embodiments. One or more portions of an embodiment or embodiments discussed in the foregoing description may be excluded from another embodiment or other embodiments. The other embodiment(s) may be provided independent of the one or more portions of the embodiment(s). Examples listed in parentheses may be used in the alternative or in any practical combination. As used in the specification and illustrative embodiments, the words 'comprising,' 'comprises,' 'including,' 'includes,' 'having,' and 'has' introduce an open-ended statement of component structures and/or functions. In the specification and illustrative embodiments, the words 'a' and 'an' are used as indefinite articles meaning 'one or more'. In the illustrative embodiments, the term "provided" is used to definitively identify an object that not a claimed or required element but an object that performs the function of a workpiece. For example, in the illustrative embodiment "an apparatus for aiming a provided barrel, the apparatus comprising: a housing, the barrel positioned in the housing", the barrel is not a claimed or required element of the apparatus, but an object that cooperates with the "housing" of the "apparatus" by being positioned in the "housing."

The location indicators "herein," "hereunder," "above," "below," or other word that refer to a location, whether specific or general, in the specification shall be construed to refer to any location in the specification whether the location is before or after the location indicator.

Methods described herein are illustrative examples, and as such are not intended to require or imply that any particular process of any embodiment be performed in the order presented. Words such as "thereafter," "then," "next," etc. are not intended to limit the order of the processes, and these words are instead used to guide the reader through the description of the methods.

The scope of the disclosure is accordingly to be limited by nothing other than the appended claims and their legal equivalents, in which reference to an element in the singular is not intended to mean "one and only one" unless explicitly so stated (e.g., "single"), but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

As used herein, numerical terms such as "first", "second", and "third" may refer to a given set of one or more elements, independent of any order associated with such set. For example, a "first" electrode may include a given electrode that may be deployed before or after a "second" electrode, absent further recited limitations of order.

What is claimed is:

1. A method, comprising:

initiating, by a processing circuit of a conducted electrical weapon, a first launch of one or more first electrodes responsive to a first activation signal of a plurality of activation signals;

initiating, by the processing circuit of the conducted electrical weapon, a second launch of one or more second electrodes responsive to a second activation signal of the plurality of activation signals; and providing, by a signal generator of the conducted electrical weapon, a current between at least one first electrode of the one or more first electrodes and at least one second electrode of the one or more second electrodes, wherein a first number of the one or more first electrodes is less than a minimum number of electrodes required by the conducted electrical weapon for remote delivery of the current.

2. The method of claim 1, wherein the minimum number is determined in accordance with a second number of different voltages generated by the signal generator for the remote delivery of the current and a third number of the different voltages to which each electrode of the one or more first electrodes and the one or more second electrodes is respectively configured to be coupled at a same time.

3. The method of claim 2, wherein the second number is two and the third number is one.

4. The method of claim 1, wherein the first number is one.

5. The method of claim 1, wherein the minimum number is equal or greater than two.

6. The method of claim 1, further comprising:

receiving, by the processing circuit, the first activation signal via a user control interface of the conducted electrical weapon.

7. The method of claim 1, further comprising:

receiving, by the processing circuit, the second activation signal via an automatic control interface of the conducted electrical weapon, wherein the automatic control interface automatically generates the second activation signal in accordance with an external event detected by the automatic control interface independent of a user of the conducted electrical weapon.

8. The method of claim 7, wherein the external event comprises a change in time, a change in spatial position of the conducted electrical weapon, and/or a change in distance between the conducted electrical weapon and a remote location.

9. The method of claim 8, wherein a second number of the one or more second electrodes is one.

10. The method of claim 1, further comprising:

receiving, by the processing circuit, the first activation signal via a wireless communication circuit of the conducted electrical weapon, wherein the first activation signal is received from a remote-control device in wireless communication with the processing circuit of the conducted electrical weapon.

11. The method of claim 1, wherein each electrode of the one or more first electrodes and each electrode of the one or more second electrodes is respectively coupled to the conducted electrical weapon via a different conductive filament.

12. The method of claim 1, wherein the second launch comprises a second number of the one or more second electrodes that is less than the minimum number.

13. A conducted electrical weapon, comprising:

a signal generator configured to generate a first voltage and a second voltage for remote delivery of a stimulus current;

a plurality of electrodes comprising one or more first electrodes and one or more second electrodes; and a processing circuit configured to launch the plurality of electrodes and electrically couple the plurality of electrodes to the signal generator, wherein the processing circuit is configured to:

provide one or more first ignition signals to initiate a first launch of the one or more first electrodes responsive to a first activation signal of a plurality of activation signals;

provide one or more second ignition signals to initiate a second launch of the one or more second electrodes responsive to a second activation signal of the plurality of activation signals; and remotely deliver the stimulus current between at least one first electrode of the one or more first electrodes and at least one second electrode of the one or more second electrodes, wherein the first launch provides less than a minimum number of electrodes required by the conducted electrical weapon for the remote delivery of the stimulus current.

14. The conducted electrical weapon of claim 13, wherein one or more first electrodes comprise only one electrode and the minimum number is determined to be two in accordance with the only one electrode being further configured to conduct one voltage at a time of either the first voltage or the second voltage.

15. The conducted electrical weapon of claim 13, further comprising at least one of a user control interface or an automatic control interface, wherein the second activation signal is received via the at least one of the user control interface or the automatic control interface, and wherein the one or more second electrodes comprise a single second electrode.

16. The conducted electrical weapon of claim 13, wherein each electrode of the plurality of electrodes is configured to provide a respective, single, electrically conductive path for the stimulus current.

17. The conducted electrical weapon of claim 13, wherein the processing circuit is further configured to initially couple the first voltage and the second voltage to the plurality of electrodes after the first launch and the second launch.

18. A handle of a conducted electrical weapon, comprising:

a control interface;

a signal generator configured to generate a first voltage and a second voltage for remote delivery of a stimulus signal; and a processing circuit configured to launch a plurality of provided electrodes and electrically couple the plurality of provided electrodes to the signal generator, wherein the processing circuit is configured to:

provide one or more first ignition signals to initiate a first launch of one or more first provided electrodes of the plurality of provided electrodes responsive to an activation signal received via the control interface;

provide one or more second ignition signals to initiate a second launch of one or more second provided electrodes of the plurality of provided electrodes responsive to another activation signal received via the control interface; and couple the first voltage and the second voltage across at least one first provided electrode of the one or more first provided electrodes and at least one second provided electrode of the one or more second provided electrodes, wherein, in accordance with the one or more first ignition signals, the first launch provides less than a minimum number of electrodes required by the conducted electrical weapon for the remote delivery of the stimulus signal.

19. The handle of claim 18, wherein the minimum number is two.

20. The handle of claim 18, wherein the one or more first ignition signals comprise a single ignition signal and the processing circuit is configured to provide the single ignition signal to a single provided electrode of the plurality of provided electrodes.

* * * * *